US011445296B2

(12) United States Patent
Honma et al.

(10) Patent No.: US 11,445,296 B2
(45) Date of Patent: Sep. 13, 2022

(54) SIGNAL PROCESSING APPARATUS AND METHOD, AND PROGRAM TO REDUCE CALCULATION AMOUNT BASED ON MUTE INFORMATION

(71) Applicant: Sony Corporation, Tokyo (JP)

(72) Inventors: Hiroyuki Honma, Chiba (JP); Toru Chinen, Kanagawa (JP); Yoshiaki Oikawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 17/284,419

(22) PCT Filed: Oct. 2, 2019

(86) PCT No.: PCT/JP2019/038846
§ 371 (c)(1),
(2) Date: Apr. 9, 2021

(87) PCT Pub. No.: WO2020/080099
PCT Pub. Date: Apr. 23, 2020

(65) Prior Publication Data

US 2021/0352408 A1 Nov. 11, 2021

(30) Foreign Application Priority Data

Oct. 16, 2018 (JP) ..... JP2018-194777

(51) Int. Cl.
*H04S 7/00* (2006.01)
*H04R 3/04* (2006.01)
*G10L 19/02* (2013.01)

(52) U.S. Cl.
CPC ..... *H04R 3/04* (2013.01); *G10L 19/02* (2013.01); *H04S 7/303* (2013.01); *H04S 7/307* (2013.01);

(Continued)

(58) Field of Classification Search
None
See application file for complete search history.

(56) References Cited

U.S. PATENT DOCUMENTS

2009/0164222 A1 6/2009 Kim et al.
2016/0133260 A1 5/2016 Hatanaka et al.
(Continued)

FOREIGN PATENT DOCUMENTS

JP 2010-505141 A 2/2010
JP 2010-516077 A 5/2010
JP 2015-194666 A 11/2015
(Continued)

OTHER PUBLICATIONS

International Search Report and English translation thereof dated Nov. 12, 2019 in connection with International Application No. PCT/JP2019/038846.
(Continued)

*Primary Examiner* — James K Mooney
(74) *Attorney, Agent, or Firm* — Wolf, Greenfield & Sacks, P.C.

(57) ABSTRACT

The present technology relates to a signal processing apparatus and method, and a program that make it possible to reduce an arithmetic operation amount.

The signal processing apparatus performs, on the basis of audio object mute information indicative of whether or not a signal of an audio object is a mute signal, at least either one of a decoding process or a rendering process of an object signal of the audio object. The present technology can be applied to a signal processing apparatus.

13 Claims, 13 Drawing Sheets

(52) U.S. Cl.
CPC ..... *H04R 2430/01* (2013.01); *H04S 2420/01* (2013.01)

(56) References Cited

U.S. PATENT DOCUMENTS

| | | | | |
|---|---|---|---|---|
| 2018/0091917 | A1* | 3/2018 | Chon | H04S 7/303 |
| 2018/0091919 | A1* | 3/2018 | Chon | H04S 3/008 |

FOREIGN PATENT DOCUMENTS

| | | | |
|---|---|---|---|
| WO | WO 2008/039039 | A1 | 4/2008 |
| WO | WO 2008/039041 | A1 | 4/2008 |
| WO | WO 2008/082276 | A1 | 7/2008 |
| WO | WO 2014/192604 | A1 | 12/2014 |
| WO | WO 2015/146057 | A1 | 10/2015 |

OTHER PUBLICATIONS

[No Author Listed], International Standard ISO/IEC 23008-3. Information technology—High efficiency coding and media delivery in heterogeneous environments—Part 3: 3D audio. First edition Oct. 15, 2015. 439 pages.

International Written Opinion and English translation thereof dated Nov. 12, 2019 in connection with International Application No. PCT/JP2019/038846.

International Preliminary Report on Patentability and English translation thereof dated Apr. 29, 2021 in connection with International Application No. PCT/JP2019/038846.

Extended European Search Report dated Feb. 10, 2022 in connection with European Application No. 19873638.1.

* cited by examiner

FIG. 12

| Syntax | No. of bits | Mnemonic |
|---|---|---|
| object_metadata() | | |
| { | | |
| for ( i=0; i < num_objects; i++) { | | |
| object_priority[i]; | 3 | uimsbf |
| position_azimuth[i]; | 8 | tcimsbf |
| position_elevation[i]; | 6 | tcimsbf |
| position_radius[i]; | 4 | uimsbf |
| } | | |
| } | | |

SIGNAL PROCESSING APPARATUS AND METHOD, AND PROGRAM TO REDUCE CALCULATION AMOUNT BASED ON MUTE INFORMATION

CROSS-REFERENCE TO RELATED APPLICATIONS

This application claims the benefit under 35 U.S.C. § 371 as a U.S. National Stage Entry of International Application No. PCT/JP2019/038846, filed in the Japanese Patent Office as a Receiving Office on Oct. 2, 2019, which claims priority to Japanese Patent Application Number JP2018-194777, filed in the Japanese Patent Office on Oct. 16, 2018, each of which is hereby incorporated by reference in its entirety.

TECHNICAL FIELD

The present technology relates to a signal processing apparatus and method, and a program, and particularly to a signal processing apparatus and method, and a program that make it possible to reduce an arithmetic operation amount.

BACKGROUND ART

In the past, an object audio technology has been used in a movie, a game and so forth, and an encoding method capable of handling an object audio has also been developed. In particular, for example, the MPEG (Moving Picture Experts Group)-H Part 3:3D audio standard that is an international standard and like standards are known (for example, refer to NPL 1).

Together with an existing 2-channel stereo method or multichannel stereo method for 5.1 channels or the like, in such an encoding method as described above, it is possible to treat a moving sound source or the like as an independent audio object and to encode position information of an object as metadata together with signal data of the audio object.

This makes it possible to perform reproduction in various viewing environments in which the number or the arrangement of speakers is different. Further, it makes it possible to easily process, upon reproduction of sound of a specific sound source, the sound of the specific sound source in volume adjustment of the sound of the specific sound source or addition of an effect to the sound of the specific sound source, which have been difficult by the existing encoding methods.

In such encoding methods as described above, decoding of a bit stream is performed by the decoding side such that an object signal that is an audio signal of an audio object and metadata including object position information indicative of the position of the audio object in a space are obtained.

Then, a rendering process for rendering the object signal to a plurality of virtual speakers that is virtually arranged in the space is performed on the basis of the object position information. For example, in the standard of NPL 1, a method called three-dimensional VBAP (Vector Based Amplitude Panning) (hereinafter referred to simply as VBAP) is used for the rendering process.

Further, after a virtual speaker signal corresponding to each virtual speaker is obtained by the rendering process, an HRTF (Head Related Transfer Function) process is performed on the basis of the virtual speaker signals. In the HRTF process, an output audio signal for allowing sound to be outputted from an actual headphone or speaker such that it sounds as if the sound were reproduced from the virtual speakers is generated.

CITATION LIST

Non Patent Literature

[NPL 1]
INTERNATIONAL STANDARD ISO/IEC 23008-3 First edition 2015-10-15 Information technology—High efficiency coding and media delivery in heterogeneous environments—Part 3: 3D audio

SUMMARY

Technical Problem

Incidentally, if the rendering process and the HRTF process are performed for the virtual speakers regarding the audio object described above, then audio reproduction can be implemented such that the sound sounds as if it were reproduced from the virtual speakers, and therefore, a high sense of presence can be obtained.

However, in the object audio, a great amount of arithmetic operation is required for a process for audio reproduction such as a rendering process and an HRTF process.

Especially, in the case where it is tried to reproduce an object audio with a device such as a smartphone, since increase of the arithmetic operation amount accelerates consumption of a battery, it is demanded to reduce the arithmetic operation amount without impairing the sense of presence.

The present technology has been made in view of such a situation as described above and makes it possible to reduce the arithmetic operation amount.

Solution to Problem

In a signal processing apparatus according to one aspect of the present technology, on the basis of audio object mute information indicative of whether or not a signal of an audio object is a mute signal, at least either one of a decoding process or a rendering process of an object signal of the audio object is performed.

A signal processing method or a program according to the one aspect of the present technology includes a step of performing, on the basis of audio object mute information indicative of whether or not a signal of an audio object is a mute signal, at least either one of a decoding process or a rendering process of an object signal of the audio object.

In the one aspect of the present technology, at least either one of a decoding process or a rendering process of an object signal of the audio object is performed on the basis of the audio object mute information indicative of whether or not the signal of the audio object is a mute signal.

BRIEF DESCRIPTION OF DRAWINGS

FIG. 12 is a view depicting an example of metadata.

DESCRIPTION OF EMBODIMENTS

In the following, embodiments to which the present technology are applied are described with reference to the drawings.

First Embodiment

<Present Technology>

The present technology makes it possible to reduce an arithmetic operation amount without causing an error of an output audio signal by omitting at least part of processing during a mute interval or by outputting a predetermined value determined in advance as a value corresponding to an arithmetic operation result without actually performing arithmetic operation during a mute interval. This makes it possible to obtain a high sense of presence while reducing the arithmetic operation amount.

First, a general process is described which is performed when decoding (decoding) is performed for a bit stream obtained by encoding using an encoding method of the MPEG-H Part 3:3D audio standard to generate an output audio signal of an object audio.

Figure 1:
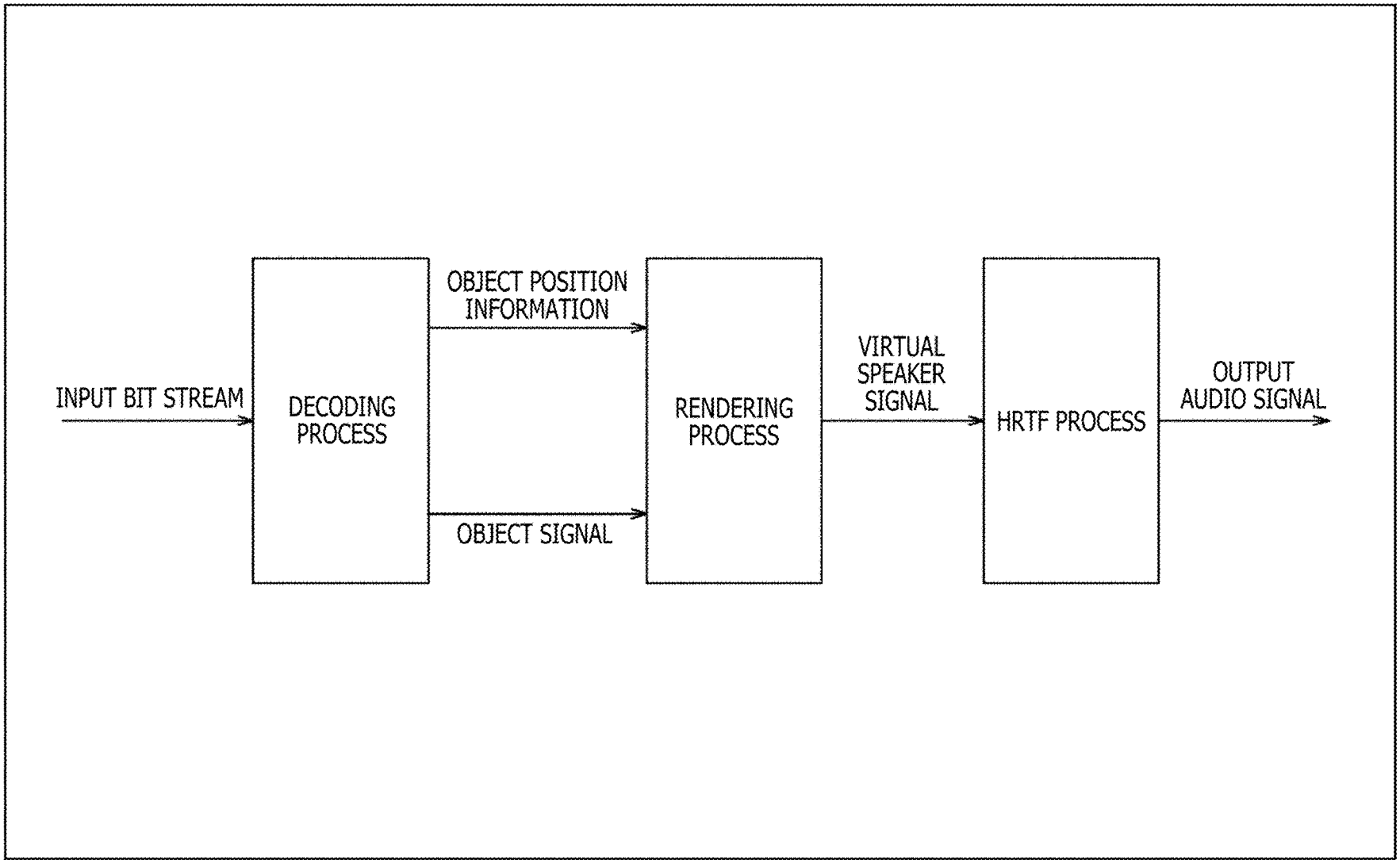
FIG. 1 is a view illustrating a process for an input bit stream.

For example, if an input bit stream obtained by encoding is inputted as depicted in FIG. 1, then a decoding process is performed for the input bit stream.

By the decoding process, an object signal that is an audio signal for reproducing sound of an audio object and metadata including object position information indicative of a position in a space of the audio object are obtained.

Then, a rendering process for rendering an object signal to virtual speakers virtually arranged in the space on the basis of the object position information included in the metadata is performed such that a virtual speaker signal for reproducing sound to be outputted from each virtual speaker is generated.

Further, an HRTF process is performed on the basis of the virtual speaker signal for each virtual speaker, and an output audio signal for causing sound to be outputted from a headphone set mounted on the user or a speaker arranged in the actual space is generated.

If sound is outputted from the actual headphone or speaker on the basis of the output audio signal obtained in such a manner as described above, then audio reproduction can be implemented such that the sound sounds as if it were reproduced from the virtual speaker. It is to be noted that, in the following description, a speaker actually arranged in an actual space is specifically referred to also as an actual speaker.

When such an object audio as described above is to be reproduced actually, in the case where a great number of actual speakers can be arranged in a space, an output of the rendering process can be reproduced as it is from the actual speakers. In contrast, in the case where a great number of actual speakers cannot be arranged in a space, the HRTF process is performed such that reproduction is performed by a small number of actual speakers such as a headphone or a sound bar. Generally, in most cases, reproduction is performed by a headphone or a small number of actual speakers.

Here, the general rendering process and HRTF process are further described.

For example, at the time of rendering, a rendering process of a predetermined method such as VBAP described above is performed. The VBAP is one of rendering methods generally called panning, and a gain is distributed, from among virtual speakers existing on a spherical surface having the origin at a position of a user, to three virtual speakers positioned nearest to an audio object existing on the same spherical surface to perform rendering.

Figure 2:
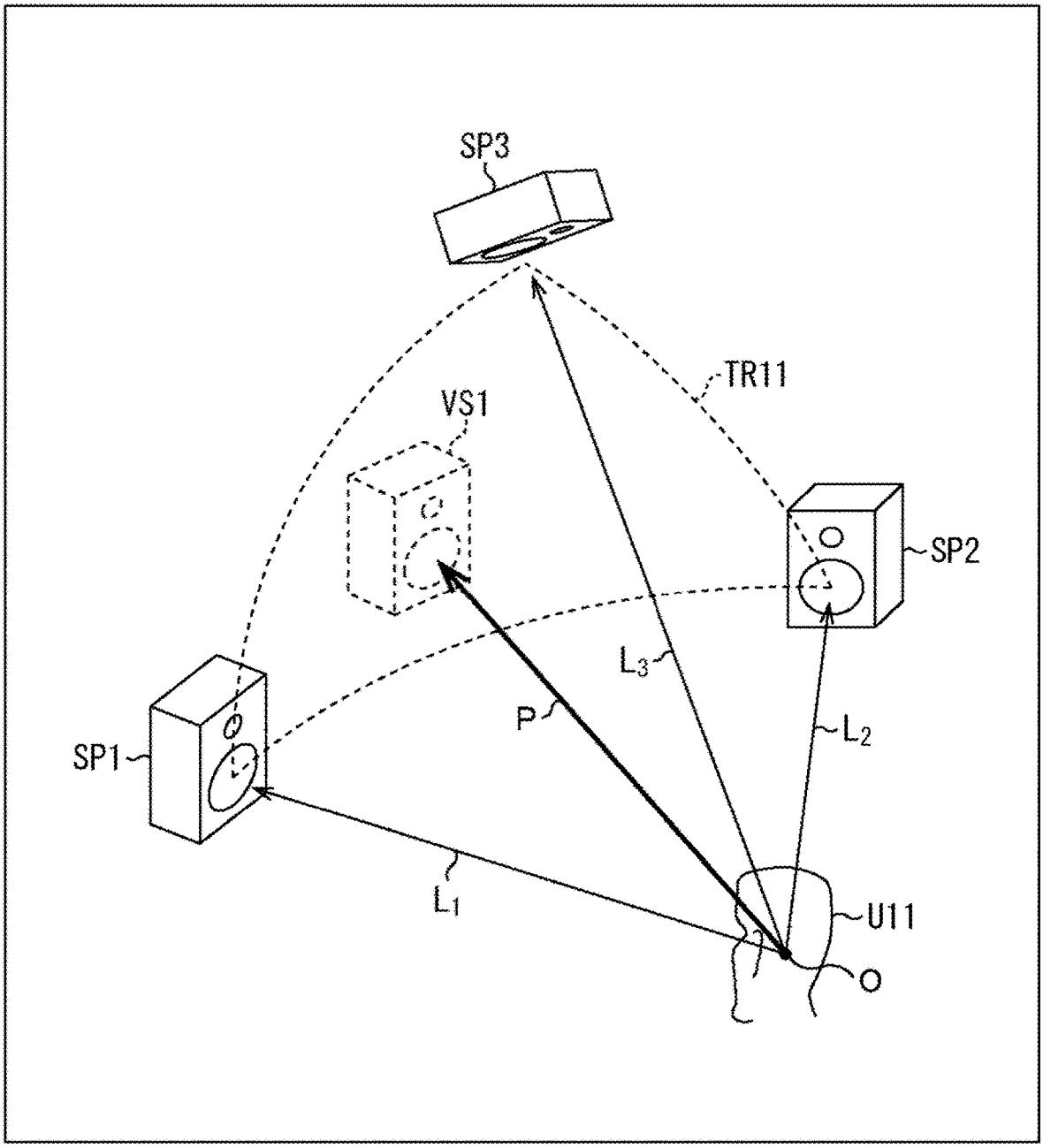
FIG. 2 is a view illustrating VBAP.

It is assumed that, for example, as depicted in FIG. 2, a user U11 who is a hearing person is in a three-dimensional space and three virtual speakers SP1 to SP3 are arranged in front of the user U11.

Here, it is assumed that a position of the head of the user U11 is determined as an origin O and the virtual speakers SP1 to SP3 are positioned on the surface of a sphere centered at the origin O.

It is assumed now that an audio object exists in a region TR11 surrounded by the virtual speakers SP1 to SP3 on the spherical surface and a sound image is localized at a position VSP1 of the audio object.

In such a case as just described, according to the VBAP, a gain regarding the audio object is distributed to the virtual speakers SP1 to SP3 existing around the position VSP1.

In particular, in a three-dimensional coordinate system whose reference (origin) is the origin O, the position VSP1 is represented by a three-dimensional vector P that starts from the origin O and ends at the position VSP1.

Further, if three-dimensional vectors starting from the origin and ending at positions of the virtual speakers SP1 to SP3 are determined as vectors $L_1$ to $L_3$, respectively, then the vector P can be represented by a linear sum of the vectors $L_1$ to $L_3$ as indicated by the following expression (1).

[Math. 1]

$$P=g_1L_1+g_2L_2+g_3L_3 \tag{1}$$

Here, if coefficients $g_1$ to $g_3$ multiplied to the vectors $L_1$ to $L_3$ in the expression (1) are calculated and such coefficients $g_1$ to $g_3$ are determined as gains of sound to be outputted from the virtual speakers SP1 to SP3, respectively, then a sound image can be localized at the position VSP1.

For example, if a vector having the coefficients $g_1$ to $g_3$ as elements thereof is given as $g_{123}=[g_1, g_2, g_3]$ and a vector having vectors $L_1$ to $L_3$ as elements thereof is given as $L_{123}=[L_1, L_2, L_3]$, then the following expression (2) can be obtained by transforming the expression (1) given hereinabove.

[Math. 2]

$$g_{123}=P^TL^{-1}{}_{123} \tag{2}$$

If sound based on the object signal is outputted from the virtual speakers SP1 to SP3 by using, as gains, the coefficients $g_1$ to $g_3$ obtained by calculation of such an expression (2) as given above, then a sound image can be localized at the position VSP1.

It is to be noted that, since the arrangement positions of the virtual speakers SP1 to SP3 are fixed and information indicative of the positions of the virtual speakers is already known, $L_{123}{}^{-1}$ that is an inverse matrix can be determined in advance.

A triangular region TR11 surrounded by three virtual speakers on the spherical surface depicted in FIG. 2 is called mesh. By combining a great number of virtual speakers arranged in a space to configure plural meshes, sound of an audio object can be localized at any position in the space.

In such a manner, if a gain for the virtual speaker is determined with respect to each audio object, then a virtual speaker signal for each virtual speaker can be obtained by performing arithmetic operation of the following expression (3).

[Math. 3]

$$\begin{bmatrix} SP(0,t) \\ SP(1,t) \\ \vdots \\ SP(M-1,t) \end{bmatrix} = \begin{bmatrix} G(0,0) & G(0,1) & \dots & G(0,N-1) \\ G(1,0) & G(1,1) & & G(1,N-1) \\ \vdots & \vdots & & \vdots \\ G(M-1,0) & G(M-1,1) & \dots & G(M-1,N-1) \end{bmatrix} \begin{bmatrix} S(0,t) \\ S(1,t) \\ \vdots \\ S(N-1,t) \end{bmatrix} \quad (3)$$

It is to be noted that, in the expression (3), SP(m,t) indicates a virtual speaker signal at time t of an mth (where, m=0, 1, . . . , M−1) virtual speaker from among M virtual speakers. Further, in the expression (3), S(n,t) indicates an object signal at time t of an nth (where, n=0, 1, . . . , N−1) audio object from among N audio objects.

Further, in the expression (3), G(m,n) indicates a gain to be multiplied to the object signal S(n,t) of the nth audio object for obtaining the virtual speaker signal SP(m,t) regarding the mth virtual speaker. In particular, the gain G(m,n) indicates a gain distributed to the mth virtual speaker regarding the nth audio object calculated in accordance with the expression (2) given hereinabove.

In the rendering process, calculation of the expression (3) is a process that requires the highest calculation cost. In other words, arithmetic operation of the expression (3) is a process in which the arithmetic operation amount is greatest.

Now, an example of the HRTF process performed in the case where sound based on the virtual speaker signal obtained by the arithmetic operation of the expression (3) is reproduced by a headphone or a small number of actual speakers is described with reference to FIG. 3. It is to be noted that, in FIG. 3, the virtual speakers are arranged on a two-dimensional horizontal plane in order to simplify the description.

Figure 3:
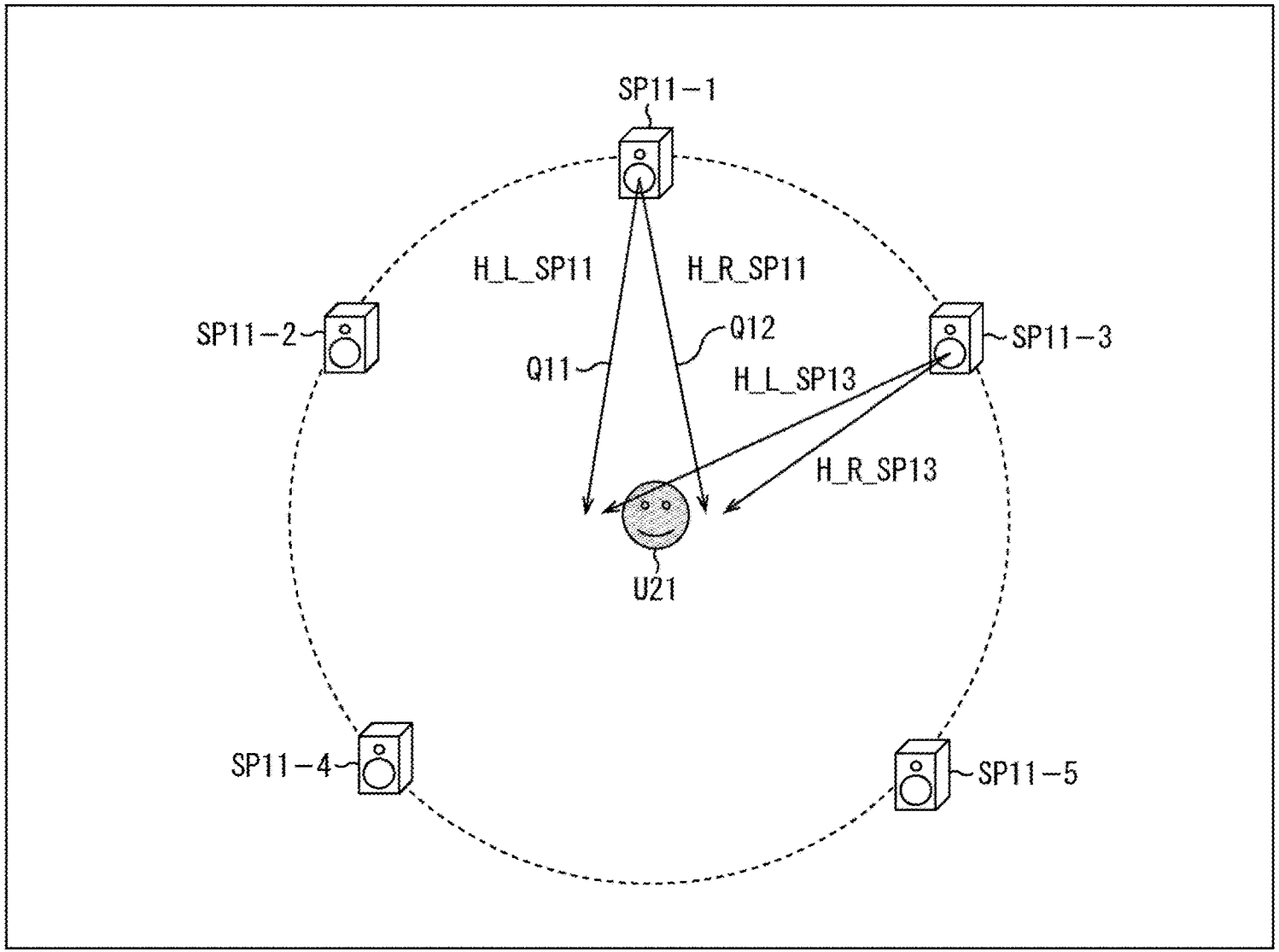
FIG. 3 is a view illustrating an HRTF process.

In FIG. 3, five virtual speakers SP11-1 to SP11-5 are arranged side by side on a circular line in a space. In the following description, in the case where there is no necessity to specifically distinguish the virtual speakers SP11-1 to SP11-5 from one another, each of the virtual speakers SP11-1 to SP11-5 is sometimes referred to simply as virtual speaker SP11.

Further, in FIG. 3, a user U21 who is a sound receiving person is positioned at a position surrounded by the five virtual speakers SP11, namely, at a central position of the circular line on which the virtual speakers SP11 are arranged. Accordingly, In the HRTF process, an output audio signal for implementing audio reproduction is generated such that the sound sounds as if the user U21 were enjoying the sound outputted from the respective virtual speakers SP11.

Especially, it is assumed that, in the present example, a listening position is given by the position at which the user U21 is and sound based on the virtual speaker signals obtained by rendering to the five virtual speakers SP11 is reproduced by a headphone.

In such a case as just described, for example, sound outputted (emitted) from the virtual speaker SP11-1 on the basis of the virtual speaker signal follows a path indicated by an arrow mark Q11 and reaches the eardrum of the left ear of the user U21. Therefore, the characteristic of sound outputted from the virtual speaker SP11-1 should be varied by the spatial transfer characteristic from the virtual speaker SP11-1 to the left ear of the user U21, the shape of the face or the ear of the user U21, the reflection absorption characteristic and so forth.

Therefore, if a transfer function H_L_SP11 obtained by taking a spatial transfer characteristic from the virtual speaker SP11-1 to the left ear of the user U21, a shape of the face or the ear of the user U21, a reflection absorption characteristic and so forth into account is convoluted into a virtual speaker signal for the virtual speaker SP11-1, then an output audio signal for reproducing sound from the virtual speaker SP11-1 to be heard by the left ear of the user U21 can be obtained.

Similarly, sound outputted from the virtual speaker SP11-1 on the basis of a virtual speaker signal follows a path indicated by an arrow mark Q12 and reaches the eardrum of the right ear of the user U21. Accordingly, if a transfer function H_R_SP11 obtained by taking a spatial transfer characteristic from the virtual speaker SP11-1 to the right ear of the user U21, a shape of the face or the ear of the user U21, a reflection absorption characteristic and so forth into account is convoluted into a virtual speaker signal for the virtual speaker SP11-1, then an output audio signal for reproducing sound from the virtual speaker SP11-1 to be heard by the right ear of the user U21 can be obtained.

From those, when sound based on virtual speaker signals for the five virtual speakers SP11 is finally reproduced by a headphone, it is sufficient if, for the left channel, a transfer function for the left ear for the respective virtual speakers is convoluted into the virtual speaker signals and signals obtained as a result of the convolution are added to form an output audio signal for the left channel.

Similarly, for the right channel, it is sufficient if a transfer function for the right ear for the respective virtual speakers is convoluted into the virtual speaker signals and signals obtained as a result of the convolution are added to form an output audio signal for the right channel.

It is to be noted that, also in the case where the device to be used for reproduction is not a headphone but an actual speaker, an HRTF process similar to that in the case of a headphone is performed. However, in this case, since sound from the speaker reaches the left and right ears of the user by spatial propagation, a process that takes crosstalk into consideration is performed as an HRTF process. Such an HRTF process as just described is also called transaural processing.

Generally, if a frequency-expressed output audio signal for the left ear, namely, for the left channel, is represented by L(ω) and a frequency-expressed output audio signal for the right ear, namely, for the right channel, is represented by R(ω), then L(ω) and R(ω) can be obtained by calculating the following expression (4).

[Math. 4]

$$\begin{bmatrix} L(\omega) \\ R(\omega) \end{bmatrix} = \begin{bmatrix} \mathrm{H_L}(0,\omega) & \mathrm{H_L}(1,\omega) & \ldots & \mathrm{H_L}(M-1,\omega) \\ \mathrm{H_R}(0,\omega) & \mathrm{H_R}(1,\omega) & \ldots & \mathrm{H_R}(M-1,\omega) \end{bmatrix} \begin{bmatrix} SP(0,\omega) \\ SP(1,\omega) \\ \vdots \\ SP(M-1,\omega) \end{bmatrix} \quad (4)$$

It is to be noted that, in the expression (4), ω indicates a frequency, and SP(m,ω) indicates a virtual speaker signal of the frequency ω for the mth (where m=0, 1, . . . , M−1) virtual speaker among M virtual speakers. The virtual speaker signal SP(m,ω) can be obtained by time frequency conversion of the virtual speaker signal SP(m,t) described hereinabove.

Further, in the expression (4), H_L(m,ω) indicates a transfer function for the left ear that is multiplied to the virtual speaker signal SP(m,ω) for the mth virtual speaker in order to obtain an output audio signal L(ω) of the left channel. Similarly, H_R(m,ω) indicates a transfer function for the right ear.

In the case where such HRTF transfer function H_L(m,ω) and transfer function H_R(m,ω) are expressed as impulse responses in the time domain, at least approximately one second is required. Therefore, in the case where, for example, the sampling frequency of the virtual speaker signals is 48 kHz, convolution of 48000 taps must be performed, and even if a high-seed calculation method that uses FFT (Fast Fourier Transform) is used for convolution of the transfer functions, a lot of arithmetic operation amount is still required.

In the case where a decoding process, a rendering process, and an HRTF process are performed to generate an output audio signal and an object audio is reproduced using a headphone or a small number of actual speakers, a lot of arithmetic operation amount is required as described above. Further, as the number of audio objects increases, this arithmetic operation amount increases that much.

Incidentally, although a stereo bit stream includes a very small number of mute intervals, generally it is very rare that an audio object bit stream includes a signal in all intervals of all audio objects.

In many audio object bit streams, approximately 30% of intervals are mute intervals, and in some cases, 60% of all intervals are mute intervals.

Therefore, in the present technology, information an audio object in a bit stream has is used to make it possible to reduce the arithmetic operation amount of a decoding process, a rendering process, and an HRTF process during mute intervals with a small arithmetic operation amount without calculating the energy of an object signal.

<Example of Configuration of Signal Processing Apparatus>

Now, an example of a configuration of a signal processing apparatus to which the present technology is applied is described.

Figure 4:
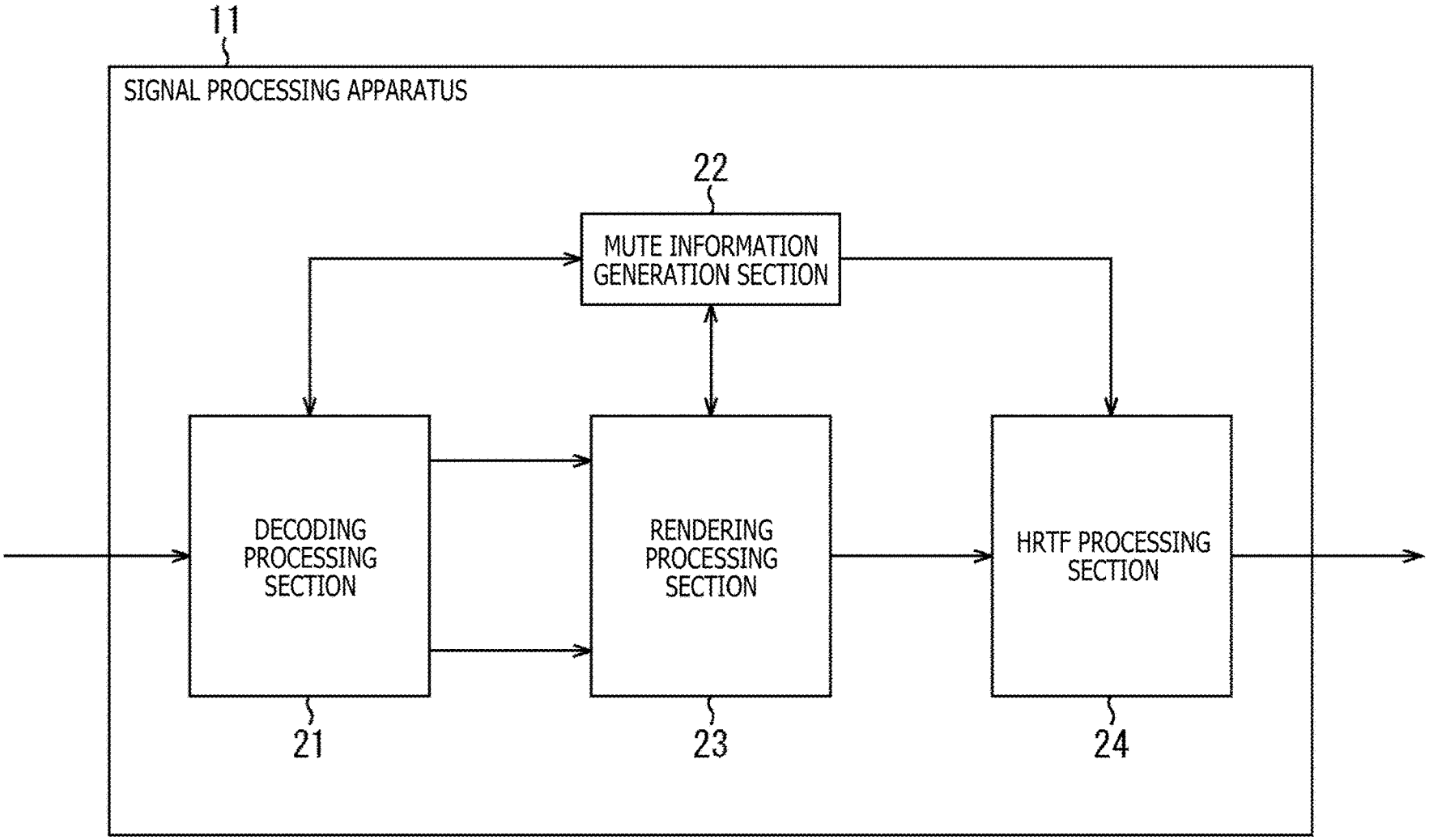
FIG. 4 is a view depicting an example of a configuration of a signal processing apparatus.

FIG. 4 is a view depicting an example of a configuration of an embodiment of the signal processing apparatus to which the present technology is applied.

A signal processing apparatus 11 depicted in FIG. 4 includes a decoding processing section 21, a mute information generation section 22, a rendering processing section 23, and an HRTF processing section 24.

The decoding processing section 21 receives and decodes (decodes) an input bit stream transmitted thereto and supplies an object signal and metadata of an audio object obtained as a result of the decoding to the rendering processing section 23.

Here, the object signal is an audio signal for reproducing sound of the audio object, and the metadata includes at least object position information indicative of a position of the audio objected in a space.

More particularly, at the time of a decoding process, the decoding processing section 21 supplies information regarding a spectrum in each time frame extracted from the input bit stream and the like to the mute information generation section 22 and receives supply of information indicative of a mute or non-mute state from the mute information generation section 22. Then, the decoding processing section 21 performs a decoding process while performing omission or the like of processing of a mute interval on the basis of the information indicative of a mute or non-mute state supplied from the mute information generation section 22.

The mute information generation section 22 receives supply of various kinds of information from the decoding processing section 21 and the rendering processing section 23, generates information indicative of a mute or non-mute state on the basis of the information supplied thereto, and supplies the information to the decoding processing section 21, the rendering processing section 23, and the HRTF processing section 24.

The rendering processing section 23 performs transfer of information to and from the mute information generation section 22 and performs a rendering process based on an object signal and metadata supplied from the decoding processing section 21 according to the information indicative of a mute or non-mute state supplied from the mute information generation section 22.

In the rendering process, a process for a mute interval is omitted or the like on the basis of the information indicative of a mute or non-mute state. The rendering processing section 23 supplies a virtual speaker signal obtained by the rendering process to the HRTF processing section 24.

The HRTF processing section 24 performs an HRTF process on the basis of the virtual speaker single supplied from the rendering processing section 23 according to the information indicative of a mute or non-mute state supplied from the mute information generation section 22 and outputs an output audio signal obtained as a result of the HRTF process to a later stage. In the HRTF process, a process for a mute interval is omitted on the basis of the information indicative of a mute or non-mute state.

It is to be noted that an example is described here in which omission or the like of arithmetic operation is performed for a portion of mute signal (mute interval) in the decoding process, the rendering process, and the HRTF process. However, only it is necessary that omission or the like of arithmetic operation (process) is performed in at least either one of the decoding process, the rendering process, or the HRTF process, and also in such a case as just described, the arithmetic operation amount can be reduced as a whole.

<Description of Output Audio Signal Generation Process>

Now, operation of the signal processing apparatus 11 depicted in FIG. 4 is described. In particular, an output audio signal generation process by the signal processing apparatus 11 is described below with reference to a flow chart of FIG. 5.

In step S11, the decoding processing section 21 performs, while performing transmission and reception of information to and from the mute information generation section 22, a decoding process for an input bit stream supplied thereto to generate an object signal and supplies the object signal and metadata to the rendering processing section 23.

For example, in step S11, the mute information generation section 22 generates spectral mute information indicative of whether or not each time frame (hereinafter referred to sometimes merely as frame) is mute, and the decoding processing section 21 executes a decoding process in which omission or the like of part of processing is performed on the basis of the spectral mute information. Further, in step S11, the mute information generation section 22 generates audio object mute information indicative of whether or not an object signal of each frame is a mute signal and supplies it to the rendering processing section 23.

In step S12, while the rendering processing section 23 performs transmission and reception of information to and from the mute information generation section 22, it performs a rendering process on the basis of the object signal and the metadata supplied from the decoding processing section 21 to generate a virtual speaker signal and supplies the virtual speaker signal to the HRTF processing section 24.

For example, in step S12, virtual speaker mute information indicative of whether or not the virtual speaker signal of each frame is a mute signal is generated by the mute information generation section 22. Further, a rendering process is performed on the basis of the audio object mute information and the virtual speaker mute information supplied from the mute information generation section 22. Especially, in the rendering process, omission of processing is performed during a mute interval.

In step S13, the HRTF processing section 24 generates an output audio signal by performing an HRTF process by which processing is omitted during a mute interval on the basis of the virtual speaker mute information supplied from the mute information generation section 22 and outputs the output audio signal to a later stage. After the output audio signal is outputted in such a manner, the output audio signal generation process is ended.

The signal processing apparatus 11 generates spectral mute information, audio object mute information, and virtual speaker mute information as information indicative of a mute or non-mute state in such a manner as described and performs, on the basis of the information, a decoding process, a rendering process, and an HRTF process to generate an output audio signal. Especially here, the spectral mute information, the audio object mute information, and the virtual speaker mute information are generated on the basis of information that can be obtained directly or indirectly from an input bit stream.

By this, the signal processing apparatus 11 performs omission or the like of processing during a mute interval and can reduce the arithmetic operation amount without damaging the presence. In other words, reproduction of an object audio can be performed with high presence while the arithmetic operation amount is reduced.

<Example of Configuration of Decoding Processing Section>

Here, the decoding process, the rendering process, and the HRTF process are described in more detail.

Figure 6:
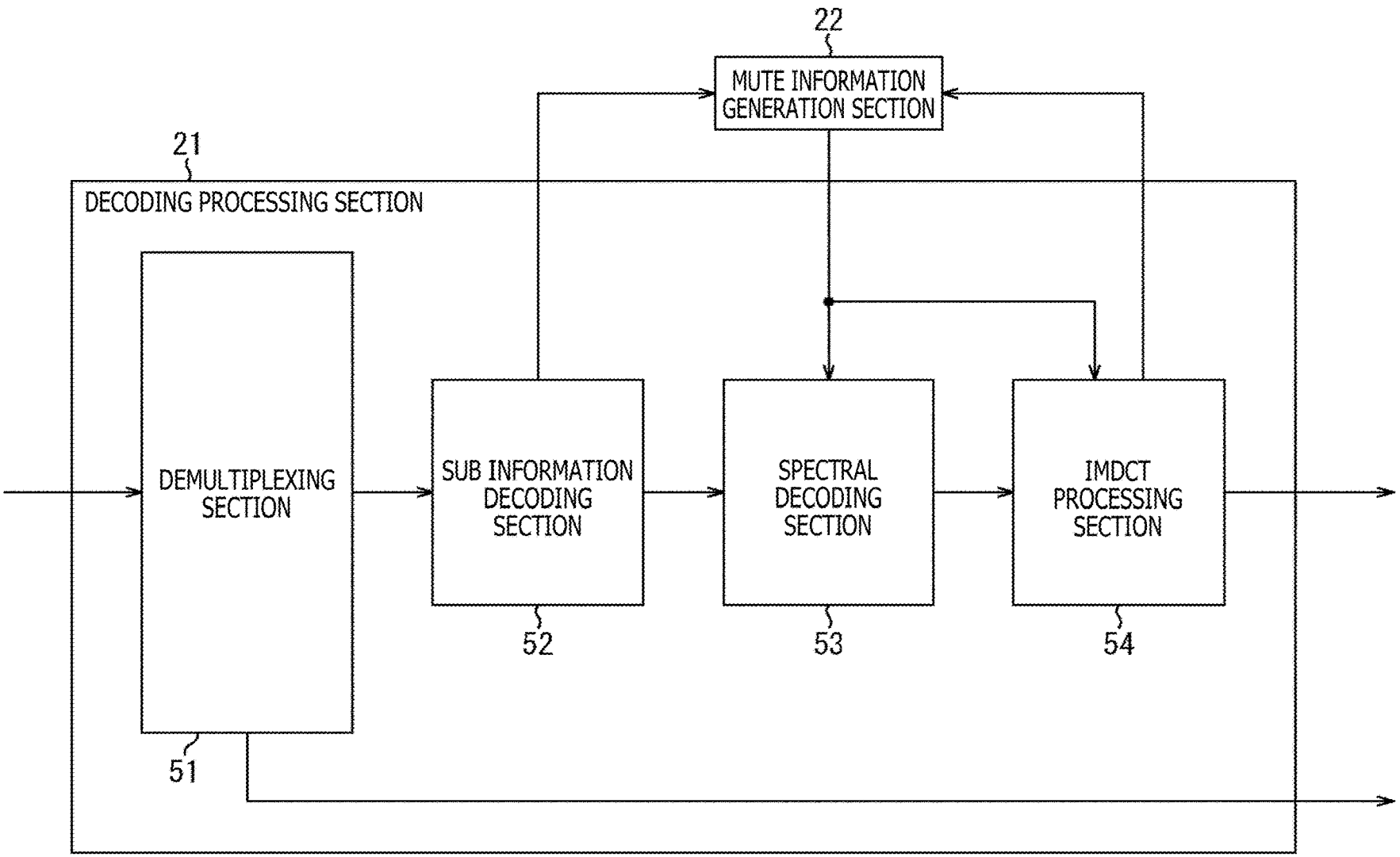
FIG. 6 is a view depicting an example of a configuration of a decoding processing section.

For example, the decoding processing section 21 is configured in such a manner as depicted in FIG. 6.

In the example depicted in FIG. 6, the decoding processing section 21 includes a demultiplexing section 51, a sub information decoding section 52, a spectral decoding section 53, and an IMDCT (Inverse Modified Discrete Cosine Transform) processing section 54.

The demultiplexing section 51 demultiplexes an input bit stream supplied thereto to extract (separate) audio object data and metadata from the input bit stream, and supplies the obtained audio object data to the sub information decoding section 52 and supplies the metadata to the rendering processing section 23.

Here, the audio object data is data for obtaining an object signal and includes sub information and spectral data.

In the present embodiment, on the encoding side, namely, on the generation side of an input bit stream, MDCT (Modified Discrete Cosine Transform) is performed for an object signal that is a time signal, and an MDCT coefficient obtained as a result of the MDCT is spectral data that is a frequency component of the object signal.

Further, on the encoding side, encoding of spectral data is performed by a context-based arithmetic encoding method. Then, the encoded spectral data and encoded sub information that is required for decoding of the spectral data are placed as audio object data into an input bit stream.

Further, as described hereinabove, the metadata includes at least object position information that is spatial position information indicative of a position of an audio object in a space.

It is to be noted that, generally, metadata is also encoded (compressed) frequently. However, since the present technology can be applied to metadata irrespective of whether or not the metadata is in an encoded state, namely, whether or not the metadata is in a compressed state, the description is continued here assuming that the metadata is not in an encoded state in order to simplify the description.

The sub information decoding section 52 decodes sub information included in audio object data supplied from the demultiplexing section 51 and supplies the decoded sub information and spectral data included in the audio object data supplied thereto to the spectral decoding section 53.

In other words, the audio object data including the decoded sub information and the spectral data in an encoded state to the spectral decoding section 53. Especially here, data other than spectral data from within data included in audio object data of each audio object included in a general input bit stream is the sub information.

Further, the sub information decoding section 52 supplies max_sfb that is information regarding a spectrum of each frame from within the sub information obtained by the decoding to the mute information generation section 22.

For example, the sub information includes information required for an IMDCT process or decoding of spectral data such as information indicative of a type of a transform window selected at the time of MDCT processing for an object signal and the number of scale factor bands with which encoding of spectral data has been performed.

In the MPEG-H Part 3:3D audio standard, in ics_info( ), max_sfb is encoded with 4 bits or 6 bits corresponding to a type of a transform window selected at the time of MDCT processing, namely, corresponding to window sequence. This max_sfb is information indicative of a quantity of encoded spectral data, namely, information indicative of the number of scale factor bands with which encoding of spectral data has been performed. In other words, the audio object data includes spectral data by an amount corresponding to the number of scale factor bands indicated by max_sfb.

For example, in the case where the value of max_sfb is 0, there is no encoded spectral data, and since all of spectral data in the frame are regarded as 0, the frame can be determined as a mute frame (mute interval).

The mute information generation section 22 generates spectral mute information of each audio object for each frame on the basis of max_sfb of each audio object for each frame supplied from the sub information decoding section 52 and supplies the spectral mute information to the spectral decoding section 53 and the IMDCT processing section 54.

Especially here, in the case where the value of max_sfb is 0, spectral mute information is generated which indicates that the target frame is a mute interval, namely, that the object signal is a mute signal. In contrast, in the case where the value of max_sfb is not 0, spectral mute information indicating that the target frame is a sounded interval, namely, that the object signal is a sounded signal, is generated.

For example, in the case where the value of the spectral mute information is 1, this indicates that the spectral mute information is a mute interval, but in the case where the value of the spectral mute information is 0, this indicates that the spectral mute information is a sounded interval, namely, that the spectral mute information is not a mute interval.

In such a manner, the mute information generation section 22 performs detection of a mute interval (mute frame) on the basis of max_sfb that is sub information and generates spectral mute information indicative of a result of the detection. This makes it possible to specify a mute frame with a very small processing amount (arithmetic operation amount) with which it is decided whether or not max_sfb extracted from an input bit stream is 0 without the necessity for calculation for obtaining energy of the object signal.

It is to be noted that, for example, "U.S. Pat. No. 9,905,232 B2, Hatanaka et al." proposes an encoding method that does not use max_sfb and separately adds, in the case where a certain channel can be deemed mute, a flag such that encoding is not performed for the channel.

According to the encoding method, the encoding efficiency can be improved by 30 to 40 bits per channel from that by encoding according to the MPEG-H Part 3:3D audio standard, and in the present technology, such an encoding method as just described may also be applied. In such a case as just described, the sub information decoding section 52 extracts a flag that is included as sub information and indicates whether or not a frame of an audio object can be deemed mute, namely, whether or not encoding of spectral data has been performed, and supplies the flag to the mute information generation section 22. Then, the mute information generation section 22 generates spectral mute information on the basis of the flag supplied from the sub information decoding section 52.

Further, in the case where increase of the arithmetic operation amount at the time of decoding processing is permissible, the mute information generation section 22 may calculate the energy of spectral data to decide whether or not the frame is a mute frame and generate spectral mute information according to a result of the decision.

The spectral decoding section 53 decodes spectral data supplied from the sub information decoding section 52 on the basis of sub information supplied from the sub information decoding section 52 and spectral mute information supplied from the mute information generation section 22. Here, the spectral decoding section 53 performs decoding of the spectral data by a decoding method corresponding to the context-based arithmetic encoding method.

For example, according to the MPEG-H Part 3:3D audio standard, context-based arithmetic encoding is performed for spectral data.

Generally, according to arithmetic encoding, not one output encoded data exists for one input data, but final output encoded data is obtained by transition of a plurality of input data.

For example, in non-context-based arithmetic encoding, since the appearance frequency table to be used for encoding of input data becomes huge or plural appearance frequency tables are switchably used, it is necessary to encode an ID representative of an appearance frequency table and transmit the ID to the decoding side separately.

In contrast, context-based arithmetic encoding, a characteristic (contents) of a frame preceding frame to a noticed spectral data or a characteristic of spectral data of a frequency lower than the frequency of the noticed spectral data is obtained by calculation as a context. Then, an appearance frequency table to be used is automatically determined on the basis of a calculation result of the context.

Therefore, in the context-based arithmetic encoding, although also the decoding side must always perform calculation of the context, there are advantages that the appearance frequency table can be made compact and besides that the ID of the appearance frequency table need not be transmitted to the decoding side.

For example, in the case where the value of the spectral mute information supplied from the mute information generation section 22 is 0 and the frame of the processing target is a sounded interval, the spectral decoding section 53 performs calculation of a context suitably using sub information supplied from the sub information decoding section 52 and a result of decoding of other spectral data.

Then, the spectral decoding section 53 selects an appearance frequency table indicated by a value determined with respect to a result of the calculation of a context, namely, by the ID, and uses the appearance frequency table to decode the spectral data. The spectral decoding section 53 supplies the decoded spectral data and the sub information to the IMDCT processing section 54.

In contrast, in the case where the spectral mute information is 1 and the frame of the processing target is a mute interval (interval of a mute signal), namely, in the case where the value of max_sfb described hereinabove is 0, since the spectral data in this frame is 0 (zero data), the ID indicative of an appearance frequency table obtained by the context calculation indicates a same value without fail. In other words, the same appearance frequency table is selected without fail.

Therefore, in the case where the value of the spectral mute information is 1, the spectral decoding section 53 does not perform context calculation, but selects an appearance frequency table indicated by an ID of a specific value determined in advance and uses the appearance frequency table to decode spectral data. In this case, for spectral data determined as data of a mute signal, context calculation is not performed. Then, the ID of the specific value determined in advance as a value corresponding to a calculation result of a context, namely, as a value indicative of a calculation result of a context, is used as an output to select an appearance frequency table, and a subsequent process for decoding is performed.

By not performing calculation of a context according to spectral mute information in such a manner, namely, by omitting calculation of a contest and outputting a value determined in advance as a value indicative of a calculation result, the arithmetic operation amount of processing at the time of decoding (decoding) can be reduced. Besides, in this case, as a decoding result of spectral data, a result quite same as that when the calculation of a context is not omitted can be obtained.

The IMDCT processing section 54 performs IMDCT (inverse modified discrete cosine transform) on the basis of spectral data and sub information supplied from the spectral decoding section 53 according to the spectral mute information supplied from the mute information generation section 22 and supplies an object obtained as a result of the IMDCT to the rendering processing section 23.

For example, in the IMDCT, processing is performed in accordance with an expression described in "INTERNATIONAL STANDARD ISO/IEC 23008-3 First edition 2015-10-15 Information technology—High efficiency coding and media delivery in heterogeneous environments—Part 3: 3D audio."

In the case where the value of max_sb is 0 and the frame of the target is a mute interval, all of the values of samples of a time signal of an output (processing result) of the IMDCT are 0. That is, the signal obtained by the IMDCT is zero data.

Therefore, in the case where the value of the spectral mute information supplied from the mute information generation section 22 is 1 and the target frame is a mute interval (interval of a mute signal), the IMDCT processing section 54 outputs zero data without performing IMDCT processing for the spectral data.

In particular, IMDCT processing is not performed actually, and zero data is outputted as a result of the IMDCT processing. In other words, as a value indicative of a processing result of the IMDCT, "0" (zero data) that is a value determined in advance is outputted.

More particularly, the IMDCT processing section 54 overlap synthesizes a time signal objected as a processing result of the IMDCT of the current frame of the processing target and a time signal obtained as a processing result of the IMDCT of a frame immediately preceding to the current frame to generate an object signal of the current frame and outputs the object signal.

The IMDCT processing section 54 can reduce the overall arithmetic operation amount of the IMDCT without giving rise to any error of the object signal obtained as an output by omitting the IMDCT processing during a mute interval. In other words, while the overall arithmetic operation amount of the IMDCT is reduced, an object signal quite same as that in the case where the IMDCT processing is not omitted can be obtained.

Generally, in the MPEG-H Part 3:3D audio standard, since decoding of spectral data and IMDCT processing in a decoding process of an audio object occupy most of the decoding process, that the IMDCT processing can be reduced leads to significant reduction of the arithmetic operation amount.

Further, the IMDCT processing section 54 supplies mute frame information indicative of whether or not a time signal of the current frame obtained as a processing result of the IMDCT is zero data, that is, whether or not the time signal is a signal of a mute interval, to the mute information generation section 22.

Consequently, the mute information generation section 22 generates audio object mute information on the basis of mute frame information of the current frame of the processing target and mute frame information of a frame immediately preceding in time to the current frame supplied from the IMDCT processing section 54 and supplies the audio object mute information to the rendering processing section 23. In other words, the mute information generation section 22 generates audio object mute information on the basis of mute frame information obtained as a result of the decoding process.

Here, in the case where both the mute frame information of the current frame and the mute frame information of the immediately preceding frame are information that they are signals during a mute interval, the mute information generation section 22 generates audio object mute information representing that the object signal of the current frame is a mute signal.

In contrast, in the case where at least either one of the mute frame information of the current frame or the mute frame information of the immediately preceding frame is information that it is not a signal during a mute interval, the mute information generation section 22 generates audio object mute information representing that the object signal of the current frame is a sounded signal.

Especially, in this example, in the case where the audio object mute information is 1, it is determined that this indicates that the object signal of the current frame a mute signal, and in the case where the audio object mute information is 0, it is determined that this indicates that the object signal is a sounded signal, namely, is not a mute signal.

As described hereinabove, the IMDCT processing section 54 generates an object signal of a current frame by overlapping synthesis with a time signal obtained as a processing result of the IMDCT of an immediately preceding frame. Accordingly, since the object signal of the current frame is influenced by the immediately preceding frame, at the time of generation of audio object mute information, it is necessary to take a result of the overlapping synthesis, namely, a processing result of the IMDCT of the immediately preceding frame, into account.

Therefore, only in the case where the value of max_sfb is 0 in both the current frame and the immediately preceding frame, namely, only in the case where zero data is obtained as a processing result of the IMDCT, the mute information generation section 22 determines that the object signal of the current frame is a frame of a mute interval.

By generating audio object mute information indicative of whether or not the object signal is mute taking the IMDCT processing into consideration in such a manner, the rendering processing section 23 at the later stage can correctly recognize whether the object signal of the frame of the processing target is mute.

<Description of Object Signal Generation Process>

Figure 5:
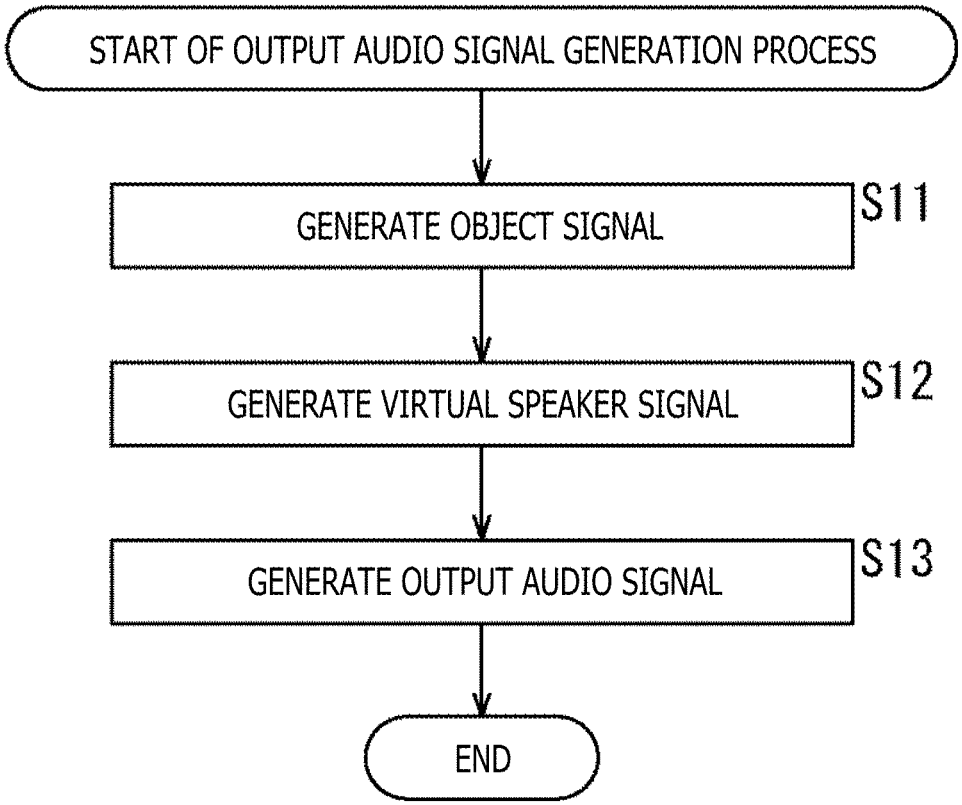
FIG. 5 is a flow chart illustrating an output audio signal generation process.
Figure 7:
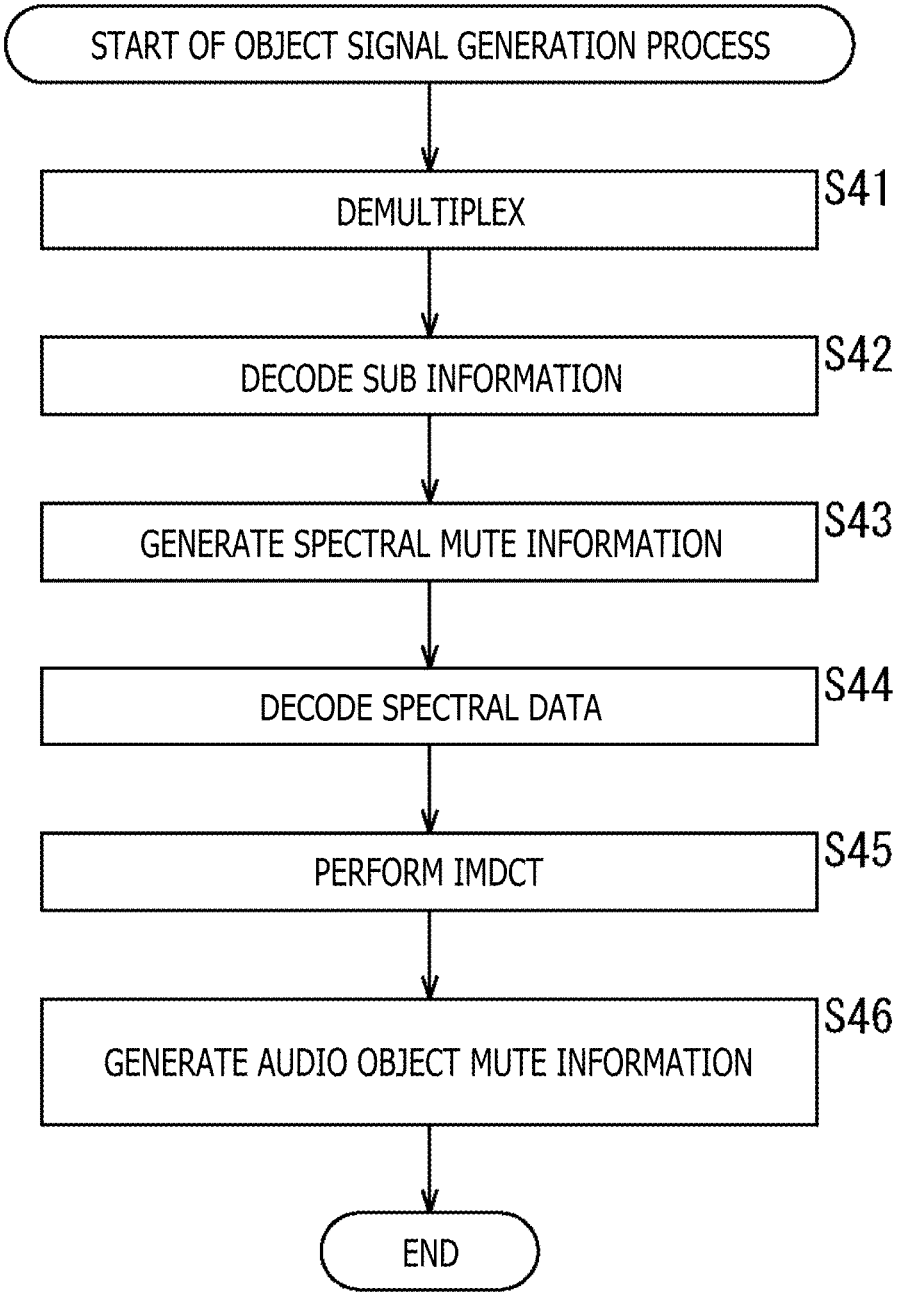
FIG. 7 is a flow chart illustrating an object signal generation process.

Now, the process in step S11 in the output audio signal generation process described with reference to FIG. 5 is described in more detail. In particular, the object signal generation process that corresponds to step S11 of FIG. 5 and is performed by the decoding processing section 21 and the mute information generation section 22 is described below with reference to a flow chart of FIG. 7.

In step S41, the demultiplexing section 51 demultiplexes the input bit stream supplied thereto and supplies audio object data and metadata obtained as a result of the demultiplexing to the sub information decoding section 52 and the rendering processing section 23, respectively.

In step S42, the sub information decoding section 52 decodes sub information included in the audio object data supplied from the demultiplexing section 51 and supplies the sub information after the decoding and spectral data included in the audio object data supplied thereto to the spectral decoding section 53. Further, the sub information decoding section 52 supplies max_sfb included in the sub information to the mute information generation section 22.

In step S43, the mute information generation section 22 generates spectral mute information on the basis of max_sfb supplied thereto from the sub information decoding section 52 and supplies the spectral mute information to the spectral decoding section 53 and the IMDCT processing section 54. For example, in the case where the value of max_sfb is 0, spectral mute information whose value is 1 is generated, but in the case where the value of max_sfb is not 0, spectral mute information whose value is 0 is generated.

In step S44, the spectral decoding section 53 decodes the spectral data supplied from the sub information decoding section 52 on the basis of the sub information supplied from the sub information decoding section 52 and the spectral mute information supplied from the mute information generation section 22.

At this time, although the spectral decoding section 53 performs decoding of the spectral data by a decoding method corresponding to a context-based arithmetic encoding method, in the case where the value of the spectral mute information is 1, the spectral decoding section 53 omits the calculation of a context at the time of decoding and performs decoding of the spectral data by using a specific appearance frequency table. The spectral decoding section 53 supplies the decoded spectral data and sub information to the IMDCT processing section 54.

In step S45, the IMDCT processing section 54 performs IMDCT on the basis of the spectral data and the sub information supplied from the spectral decoding section 53 according to the spectral mute information supplied from the mute information generation section 22 and supplies an object signal obtained as a result of the IMDCT to the rendering processing section 23.

At this time, when the value of the spectral mute information supplied from the mute information generation section 22 is 1, the IMDCT processing section 54 does not perform the IMDCT process but performs an overlap synthesis by using the zero data to generate an object signal. Further, the IMDCT processing section 54 generates mute frame information according to whether or not the processing result of the IMDCT is zero data and supplies the mute frame information to the mute information generation section 22.

The processes of demultiplexing, decoding of the sub information, decoding of the spectral data, and IMDCT described above are performed as a decoding process for the input bit stream.

In step S46, the mute information generation section 22 generates audio object mute information on the basis of the mute frame information supplied from the IMDCT processing section 54 and supplies the audio object mute information to the rendering processing section 23.

Here, audio object mute information of a current frame is generated on the basis of the mute frame information of a current frame and an immediately preceding frame. After the audio object mute information is generated, the object signal generation process is ended.

The decoding processing section 21 and the mute information generation section 22 decode an input bit stream to generate an object signal in such a manner as described above. At this time, by generating spectral mute information such that calculation of a context or a process of IMDCT is not performed suitably, the arithmetic operation amount of the decoding process can be reduced without giving rise to an error in an object signal obtained as a decoding result. This makes it possible to obtain high presence even with a small amount of arithmetic operation.

<Example of Configuration of Rendering Processing Section>

Subsequently, a configuration of the rendering processing section 23 is described. For example, the rendering processing section 23 is configured in such a manner as depicted in FIG. 8.

Figure 8:
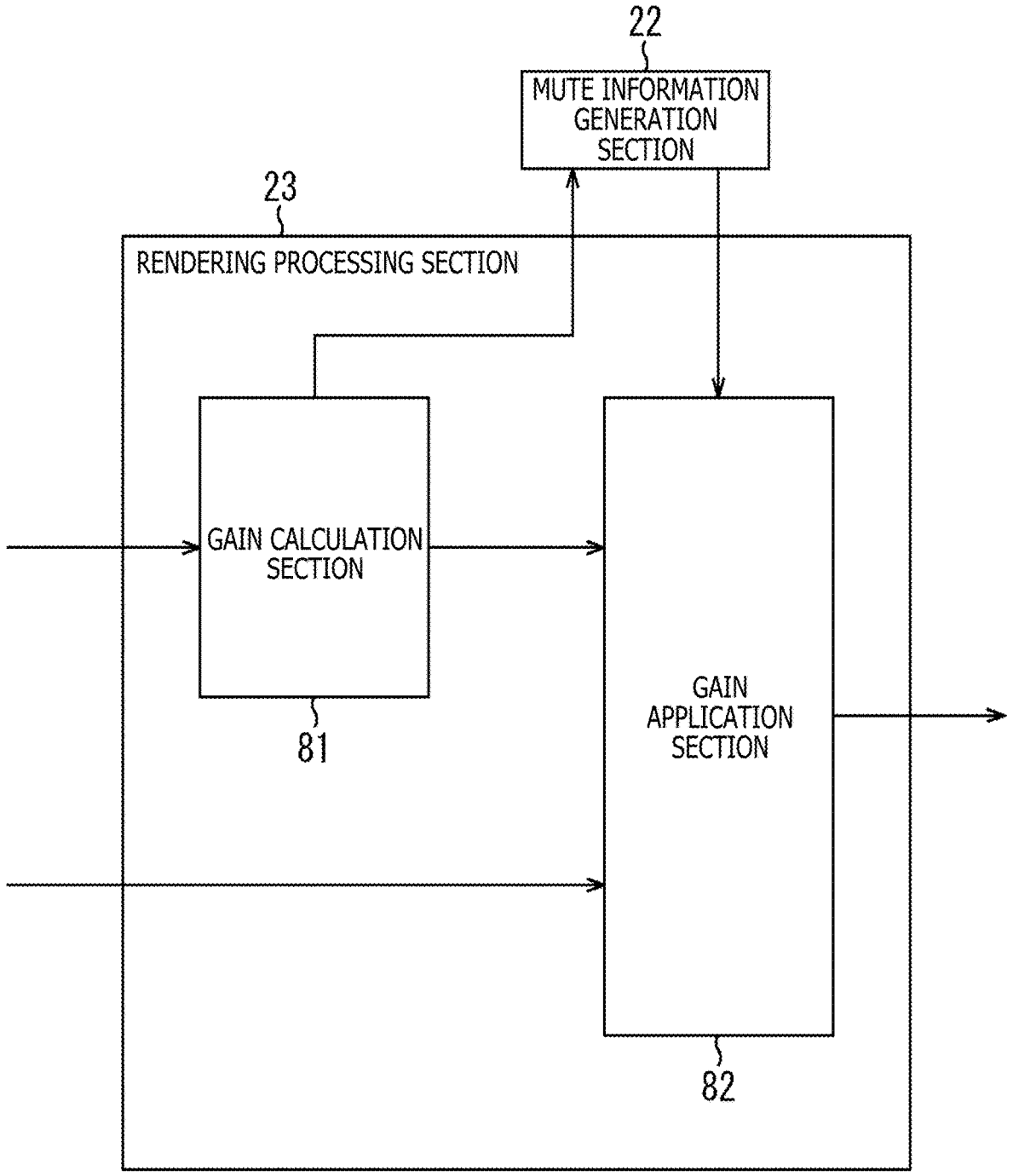
FIG. 8 is a view depicting an example of a configuration of a rendering processing section.

The rendering processing section 23 depicted in FIG. 8 includes a gain calculation section 81 and a gain application section 82.

The gain calculation section 81 calculates, on the basis of object position information included in metadata supplied from the demultiplexing section 51 of the decoding processing section 21, a gain corresponding to each virtual speaker, namely, for each object signal, and supplies the gains to the gain application section 82. Further, the gain calculation section 81 supplies, to the mute information generation section 22, search mesh information indicative of meshes in each of which all of gains for the virtual speakers configuring the mesh, namely, the virtual speakers located at the three apexes of the mesh, have values equal to or higher than a predetermined value from among plural meshes.

The mute information generation section 22 generates virtual speaker mute information for each virtual speaker on the basis of the search mesh information supplied from the gain calculation section 81 for each audio object, namely, for each object signal, in each frame and the audio object mute information.

The value of the virtual speaker mute information is 1 in the case where the virtual speaker signal is a signal during a mute interval (mute signal) but is 0 in the case where the virtual speaker signal is not a signal during a mute interval, namely, in the case where the virtual speaker signal is a signal during a sounded interval (sounded signal).

To the gain application section 82, audio object mute information and virtual speaker mute information are supplied from the mute information generation section 22 and a gain is supplied from the gain calculation section 81 while an object signal is supplied from the IMDCT processing section 54 of the decoding processing section 21.

The gain application section 82 multiplies, on the basis of the audio object mute information and the virtual speaker mute information, an object signal by a gain from the gain calculation section 81 for each virtual speaker and adds the object signal multiplied by the gain to generate a virtual speaker signal.

At this time, the gain application section 82 does not perform an arithmetic operation process for generating a virtual speaker signal for a mute object signal or a mute virtual speaker signal according to the audio object mute information and the virtual speaker mute information. In other words, arithmetic operation of at least part of the arithmetic operation process for generating a virtual speaker signal is omitted. The gain application section 82 supplies the obtained virtual speaker signal to the HRTF processing section 24.

In such a manner, the rendering processing section 23 performs a process, which includes a gain calculation process for obtaining by calculating a gain for a virtual speaker, more particularly, for part of a gain calculation process hereinafter described with reference to FIG. 10 and a gain application process for generating a virtual speaker signal, as a rendering process.

<Description of Virtual Speaker Signal Generation Process>

Here, the process in step S12 in the output audio signal generation process described hereinabove with reference to FIG. 5 is described in more detail. In particular, the virtual speaker signal generation process that corresponds to step S12 of FIG. 5 and is performed by the rendering processing section 23 and the mute information generation section 22 is described with reference to a flow chart of FIG. 9.

In step S71, the gain calculation section 81 and the mute information generation section 22 perform a gain calculation process.

In particular, the gain calculation section 81 performs calculation of the expression (2) given hereinabove for each object signal on the basis of object position information included in metadata supplied from the demultiplexing section 51 to calculate a gain for each virtual speaker and supplies the gains to the gain application section 82. Further, the gain calculation section 81 supplies search mesh information to the mute information generation section 22.

Further, the mute information generation section 22 generates, for each object signal, virtual speaker mute information on the basis of the search mesh information supplied from the gain calculation section 81 and the audio object mute information. The mute information generation section 22 supplies the audio object mute information and the virtual speaker mute information to the gain application section 82 and supplies the virtual speaker mute information to the HRTF processing section 24.

In step S72, the gain application section 82 generates a virtual speaker signal on the basis of the audio object mute information, the virtual speaker mute information, the gain from the gain calculation section 81, and the object signal from the IMDCT processing section 54.

At this time, the gain application section 82 does not perform, namely, omits, at least part of the arithmetic operation process for generating a virtual speaker signal according to the audio object mute information and the virtual speaker mute information to reduce the arithmetic operation amount of the rendering process.

In this case, since the process during an interval during which the object signal and the virtual speaker signal are mute is omitted, as a result, a virtual speaker signal quite same as that in the case where the process is not omitted is obtained. In other words, the arithmetic operation amount can be reduced without giving rise to an error of the virtual speaker signal.

The calculation (computation) of a gain and the processes for generating a virtual speaker signal described above are performed as a rendering process by the rendering processing section 23.

The gain application section 82 supplies the obtained virtual speaker signal to the HRTF processing section 24, and the virtual speaker signal generation process is ended.

The rendering processing section 23 and the mute information generation section 22 generate virtual speaker mute information and generate a virtual speaker signal in such a manner as described above. At this time, by omitting at least part of the arithmetic operation process for generating a virtual speaker signal according to audio object mute information and virtual speaker mute information, the arithmetic operation amount of the rendering process can be reduced without giving rise to any error in a virtual speaker signal obtained as a result of the rendering process. Consequently, high presence can be obtained even with a small amount of arithmetic operation.

<Description of Gain Calculation Process>

Figure 9:
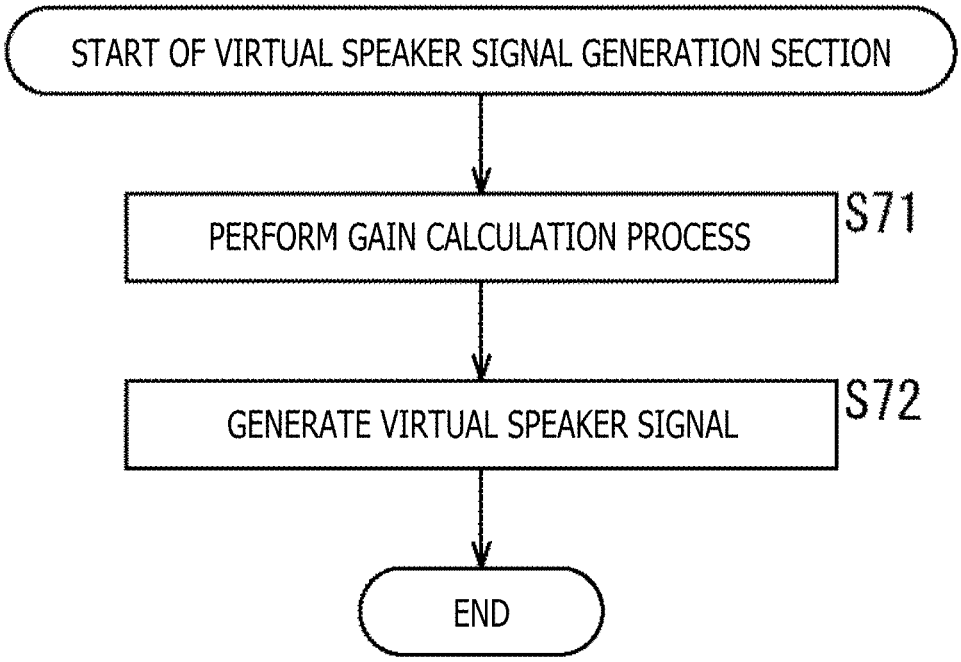
FIG. 9 is a flow chart illustrating a virtual speaker signal generation process.

Further, the gain calculation process performed in step S71 of FIG. 9 is performed for each audio object. More particularly, processes depicted in FIG. 10 are performed as the gain calculation process. In the following, the gain calculation process that corresponds to the process in step S71 of FIG. 9 and is performed by the rendering processing section 23 and the mute information generation section 22 is described with reference to a flow chart of FIG. 10.

In step S101, the gain calculation section 81 and the mute information generation section 22 initialize the value of an index obj_id indicative of an audio object that is a processing target to 0, and the mute information generation section 22 further initializes the values of virtual speaker mute information a_spk_mute[spk_id] for all virtual speakers to 1.

Here, it is assumed that the number of object signals obtained from the input bit stream, namely, the total number of audio objects, is max_obj. Then, it is assumed that the object signals are determined as an audio object of the processing target in order beginning with the audio object indicated by the index obj_id=0 and ending with the audio object indicated by the index obj_id=max_obj−1.

Further, spk_id is an index indicative of a virtual speaker, and a_spk_mute[spk_id] indicates virtual speaker mute information regarding the virtual speaker indicated by the index spk_id. As described hereinabove, in the case where the value of the virtual speaker mute information a_spk_mute[spk_id] is 1, this indicates that the virtual speaker mute signal corresponding to the virtual speaker is mute.

Note that it is assumed that the total number of virtual speakers arranged in the space here is max_spk. Accordingly, in this example, totaling max_spk virtual speakers from the virtual speaker indicated by the index spk_id=0 to the virtual speaker indicated by the index spk_id=max_spk−1 exist.

In step S101, the gain calculation section 81 and the mute information generation section 22 set the value of the index obj_id indicative of the audio object of the processing target to 0.

Further, the mute information generation section 22 sets the value of the virtual speaker mute information a_spk_mute[spk_id] regarding each index spk_id (where 0 spk_id max_spk−1) to 1. Here, it is assumed for the time being that virtual speaker signals of all virtual speakers are mute.

In step S102, the gain calculation section 81 and the mute information generation section 22 set the value of an index mesh_id indicative of a mesh that is a processing target to 0.

Here, it is assumed that max_mesh meshes are formed by the virtual speakers in the space. In other words, the total number of meshes existing in the space is max_mesh. Further, it is assumed here that the meshes are selected as a mesh of a processing target in order beginning with the mesh indicated by the index mesh_id=0, namely, in the ascending order of the value of the index mesh_id.

In step S103, the gain calculation section 81 obtains gains of three virtual speakers configuring the mesh of the index mesh_id that is a processing target by calculating the expression (2) given hereinabove for the audio object of the index obj_id of the processing target.

In step S103, object position information of the audio object of the index obj_id is used to perform calculation of the expression (2). Consequently, gains $g_1$ to $g_3$ of respective three virtual speakers are obtained.

In step S104, the gain calculation section 81 decides whether or not all of the three gains $g_1$ to $g_3$ obtained by calculation in step S103 are equal to or higher than a threshold value TH1 determined in advance.

Here, the threshold value TH1 is a floating point number equal to or lower than 0 and is a value determined, for example, by arithmetic operation accuracy of an equipped apparatus. Generally, as the value of the threshold value TH1, a small value of approximately $-1\times10^{-5}$ is frequently used.

For example, in the case where all of the gains $g_1$ to $g_3$ regarding the audio object of the processing target are equal to or higher than the threshold value TH1, this indicates that the audio object exists (is located) in the mesh of the processing target. In contrast, in the case where any one of the gains $g_1$ to $g_3$ is lower than the threshold value TH1, this indicates that the audio object of the processing target does not exist (is not positioned) in the mesh of the processing target.

In the case where it is intended to reproduce sound of the audio object of the processing target, only it is necessary that sound is outputted only from the three virtual speakers configuring the mesh in which the audio object is included, and it is sufficient if virtual speaker signals for the other virtual speakers are made a mute signal. Therefore, in the gain calculation section 81, search for a mesh including an audio object of a processing target is performed, and the value of the virtual speaker mute information is determined according to a result of the search.

In the case where it is decided in step S104 that all of the three gains $g_1$ to $g_3$ are not equal to or higher than the threshold value TH1, the gain calculation section 81 decides in step S105 that the value of the index mesh_id of the mesh of the processing target is lower than max_mesh, namely, whether or not mesh_id<max_mesh is satisfied.

In the case where it is decided in step S105 that mesh_id<max_mesh is not satisfied, the processing advances to step S110. It is to be noted that basically it is not presupposed in step S105 that mesh_id<max_mesh is satisfied.

In contrast, in the case where it is decided in step S105 that mesh_id<max_mesh is satisfied, the processing advances to step S106.

In step S106, the gain calculation section 81 and the mute information generation section 22 increment the value of the index mesh_id indicative of the mesh of the processing target by one.

After the process in step S106 is performed, the processing returns to step S103 and the processes described above are performed repeatedly. In particular, the process for calculating a gain is performed repeatedly until a mesh that includes the audio object of the processing target is detected.

On the other hand, in the case where it is decided in step S104 that all of the three gains $g_1$ to $g_3$ are equal to or higher than the threshold value TH1, the gain calculation section 81 generates search mesh information indicative of the mesh of the index mesh_id that is the processing target and supplies the search mesh information to the mute information generation section 22. Thereafter, the processing advances to step S107.

In step S107, the mute information generation section 22 decides whether or not the value of the audio object mute information a_obj_mute[obj_id] of the object signal of the audio object of the index obj_id of the processing target is 0.

Here, a_obj_mute[obj_id] indicates audio object mute information of the audio object whose index is obj_id. As described hereinabove, in the case where the value of the audio object mute information a_obj_mute[obj_id] is 1, this indicates that the object signal of the audio object of the index obj_id is a mute signal.

In contrast, in the case where the value of the audio object mute information a_obj_mute[obj_id] is 0, this indicates that the object signal of the audio object of the index obj_id is a sounded signal.

In the case where it is decided in step S107 that the value of the audio object mute information a_obj_mute[obj_id] is 0, namely, in the case where the object signal is a sounded signal, the processing advances to step S108.

In step S108, the mute information generation section 22 sets the value of the virtual speaker mute information of the three virtual speakers configuring the mesh of the index mesh_id indicated by the search mesh information supplied from the gain calculation section 81 to 0.

For example, for the mesh of the index mesh_id, the information indicative of the mesh is set to mesh information mesh_info[mesh_id]. This mesh information mesh_info [mesh_id] has indices spk_id=spk1, spk2, and spk3 indicative of the three virtual speakers configuring the mesh of the index mesh_id as member variables.

Especially, the index spk_id indicative of the first virtual speaker configuring the mesh of the index mesh_id is represented specifically as spk_id=mesh_info [mesh_id].spk1.

Similarly, the index spk_id indicative of the second virtual speaker configuring the mesh of the index mesh_id is represented as spk_id=mesh_info[mesh_id].spk2, and the index spk_id indicative of the third virtual speaker configuring the mesh of the index mesh_id is represented as spk_id=mesh_info[mesh_id].spk3.

In the case where the value of the audio object mute information a_obj_mute[obj_id] is 0, since the object signal of the audio object is sounded, the sound outputted from the three virtual speakers configuring the mesh including the audio object is sounded.

Therefore, the mute information generation section 22 changes each of the values of virtual speaker mute information a_spk_mute[mesh_info[mesh_id].spk1], virtual speaker mute information a_spk_mute[mesh_info [mesh_id].spk2], and virtual speaker mute information a_spk_mute[mesh_info[mesh_id].spk3] of the three virtual speakers configuring the mesh of the index mesh_id from 1 to 0.

In such a manner, in the mute information generation section 22, virtual speaker mute information is generated on the basis of a calculation result (computing result) of the gains for the virtual speakers and audio object mute information.

After setting of virtual speaker mute information is performed in such a manner, the processing advances to step S109.

On the other hand, in the case where it is decided in step S107 that the audio object mute information a_obj_mute [obj_id] is not 0, namely, is 1, the process in step S108 is not performed, and the processing advances to step S109.

In this case, since the object signal of the audio object of the processing target is mute, the values of the virtual speaker mute information a_spk_mute[mesh_info [mesh_id].spk1], the virtual speaker mute information a_spk_mute[mesh_info[mesh_id].spk2], and the virtual speaker mute information a_spk_mute[mesh_info [mesh_id].spk3] of the virtual speakers are left to be 1 as having been set in step S101.

If the process in step S108 is performed or if it is decided in step S107 that the value of the audio object mute information is 1, then a process in step S109 is performed.

In particular, in step S109, the gain calculation section 81 sets the gains obtained by calculation in step S103 as values of the gain of the three virtual speakers configuring the mesh of the index mesh_id of the processing target.

For example, it is assumed that the gain of the virtual speaker of the index spk_id regarding the audio object of the index obj_id is represented as a_gain[obj_id][spk_id].

Further, it is assumed that the gain of the virtual speaker corresponding to the index spk_id=mesh_info [mesh_id].spk1 from among the gains $g_1$ to $g_3$ obtained by calculation in step S103 is $g_1$. Similarly, it is assumed that the gain of the virtual speaker corresponding to the index spk_id=mesh_info[mesh_id].spk2 is $g_2$ and the gain of the virtual speaker corresponding to the index spk_id=mesh_info[mesh_id].spk3 is $g_3$.

In such a case as just described, it is assumed that the gain calculation section 81 sets the gain a_gain[obj_id] [mesh_info[mesh_id].spk1] of the virtual speaker=$g_1$ on the basis of a result of the calculation in step S103. Similarly, the gain calculation section 81 sets the gain a_gain[obj_id] [mesh_info[mesh_id].spk2]=$g_2$ and sets the gain a_gain [obj_id][mesh_info[mesh_id].spk3]=$g_3$.

After the gains of the three virtual speakers configuring the mesh of the processing target are determined in such a manner, the processing advances to step S110.

If it is decided in step S105 that mesh_id<max_mesh is not satisfied or if the process in step S109 is performed, then the gain calculation section 81 decides in step S110 whether or not obj_id<max_obj is satisfied. In other words, it is decided whether or not the process has been performed for all audio objects as the processing target.

In the case where it is decided in step S110 that obj_id<max_obj is satisfied, namely, that all of the audio objects have not been set as the processing target, the processing advances to step S111.

In step S111, the gain calculation section 81 and the mute information generation section 22 increment the value of the index obj_id indicative of an audio object that is a processing target by 1. After the process in step S111 is performed, the processing returns to step S102 and the processes described above are performed repeatedly. In particular, for the audio object set as a processing target newly, a gain is calculated and setting of virtual speaker mute information is performed.

On the other hand, in the case where it is decided in step S110 that obj_id<max_obj is not satisfied, since the processing has been performed for all audio objects set as a processing target, the gain calculation process is ended. When the gain calculation process ends, a state is established in which gains of each of the virtual speakers are obtained for all object signals and virtual speaker mute information is generated for each of the virtual speakers.

The rendering processing section 23 and the mute information generation section 22 calculate gains of the virtual speakers and generate virtual speaker mute information in such a manner as described above. If the virtual speaker mute information is generated in such a manner, then since it can be recognized correctly whether a virtual speaker signal is mute, the gain application section 82 and the HRTF processing section 24 at the later stages can omit a process appropriately.

<Description of Smoothing Process>

Figure 10:
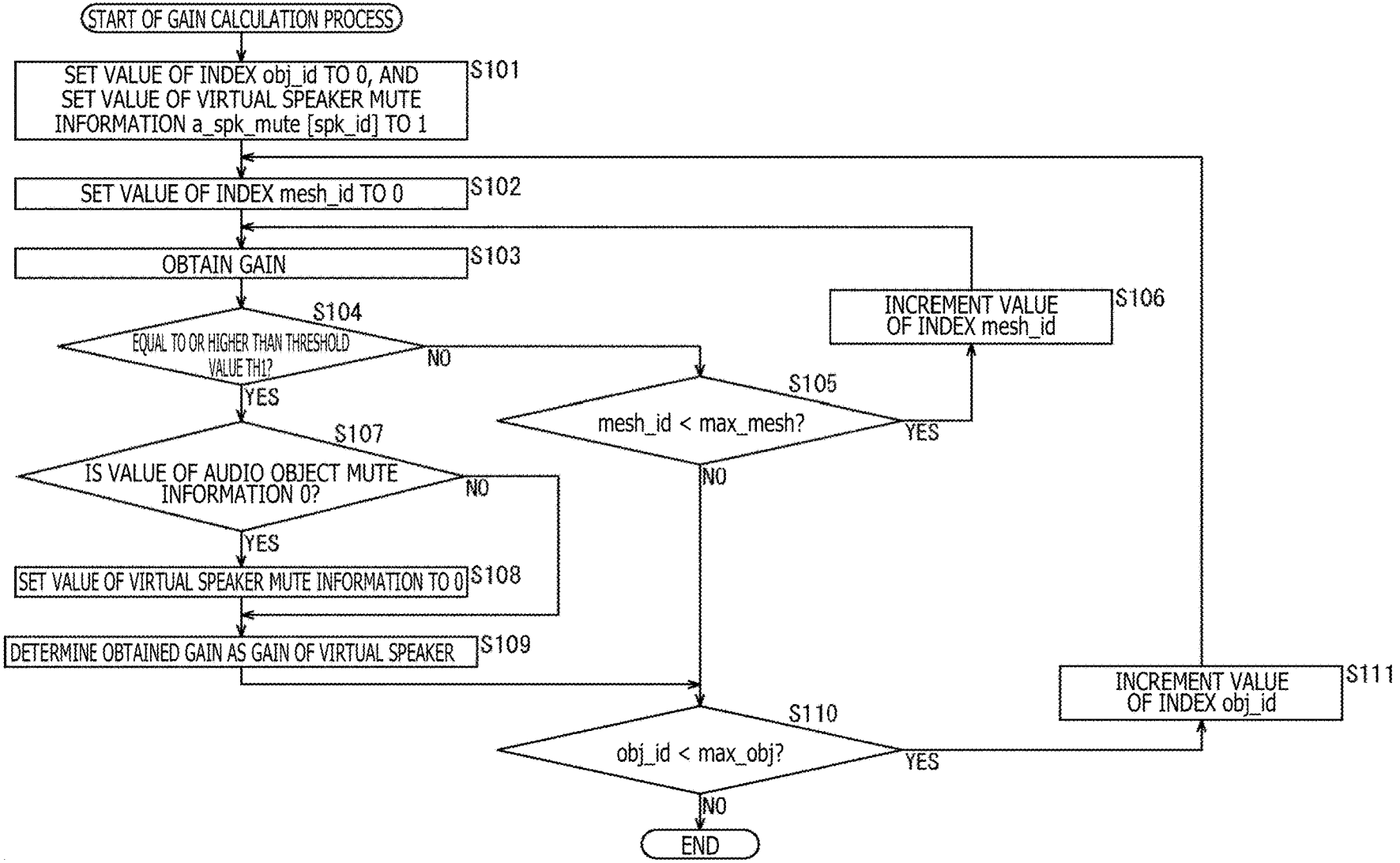
FIG. 10 is a flow chart illustrating a gain calculation process.

In step S72 of the virtual speaker signal generation process described hereinabove with reference to FIG. 9, the gains of virtual speakers and virtual speaker mute information obtained by the gain calculation process described hereinabove, for example, with reference to FIG. 10 are used.

However, in the case where, for example, the position of an audio object changes for each time frame, the gain sometimes fluctuates suddenly at a changing point of the position of the audio object. In such a case as just described, if the gains determined in step S109 of FIG. 10 are used as they are, then noise is generated in the virtual speaker signals, and therefore, it is possible to perform a smoothing process such as linear interpolation using not only the gains in the current frame but also the gains in the immediately preceding frame.

In such a case as just described, the gain calculation section 81 performs a gain smoothing process on the basis of the gains in the current frame and the gains in the immediately preceding frames and supplies the gains after the smoothing (smoothing) as gains of the current frame obtained finally to the gain application section 82.

In the case where gain smoothing is performed in such a manner, it is necessary to perform the smoothing (smoothing) taking virtual speaker mute information in the current frame and the immediately preceding frame also into account. In this case, the mute information generation section 22 performs a smoothing process depicted, for example, in FIG. 11 to smooth the virtual speaker mute information of each virtual speaker. In the following, the smoothing process by the mute information generation section 22 is described with reference to a flow chart of FIG. 11.

In step S141, the mute information generation section 22 sets the value of the index spk_id≤(where 0 spk_id≤max_spk−1) indicative of a virtual speaker that is a processing target.

Further, it is assumed that the virtual speaker mute information of the current frame obtained for the virtual speaker of the processing target indicated by the index spk_id here is represented as a_spk_mute[spk_id] and the virtual speaker mute information of the immediately preceding frame to the current frame is represented as a_prev_spk_mute[spk_id].

In step S142, the mute information generation section 22 decides whether or not the virtual speaker mute information of the current frame and the immediately preceding frame is 1.

In particular, it is decided whether or not both the value of the virtual speaker mute information a_spk_mute[spk_id] of the current frame and the virtual speaker mute information a_prev_spk_mute[spk_id] of the immediately preceding frame are 1.

In the case where it is decided in step S142 that the virtual speaker mute information is 1, the mute information generation section 22 determines, in step S143, the final value of the virtual speaker mute information a_spk_mute[spk_id] of the current frame as 1. Thereafter, the processing advances to step S145.

On the other hand, in the case where it is decided in step S142 that the virtual speaker mute information is not 1, namely, in the case where the virtual speaker mute information of at least either one of the current frame or the immediately preceding frame is 0, the processing advances to step S144. In this case, in at least either one of the current frame or the immediately preceding frame, the virtual speaker signal is sounded.

In step S144, the mute information generation section 22 sets the final value of the virtual speaker mute information a_spk_mute[spk_id] of the current frame to 0, and then the processing advances to step S145.

For example, in the case where the virtual speaker signal is sounded in at least either one of the current frame or the immediately preceding frame, by setting the value of the virtual speaker mute information of the current frame to 0, such a situation can be prevented that sound of a virtual speaker signal is interrupted and becomes mute or the sound of a virtual speaker signal becomes sounded suddenly.

After the process in step S143 or step S144 is performed, the process in step S145 is performed.

In step S145, the mute information generation section 22 determines the virtual speaker mute information a_spk_mute[spk_id] obtained by the gain calculation process of FIG. 10 regarding the current frame of the processing target as virtual speaker mute information a_prev_spk_mute [spk_id] of an immediately preceding frame to be used in the next smoothing process. In other words, the virtual speaker mute information a_spk_mute[spk_id] of the current frame is used as virtual speaker mute information a_prev_spk_mute[spk_id] in the smoothing process in a next cycle.

In step S146, the mute information generation section 22 decides whether or not spk_id<max_spk is satisfied. In other words, it is decided whether or not the process has been performed for all virtual speaker as the processing target.

In the case where it is decided in step S146 that spk_id<max_spk is satisfied, since all of the virtual speakers have not been processed as the processing target as yet, the mute information generation section 22 increments the value of the index spk_id indicative of the virtual speaker of the processing target by 1 in step S147.

After the process in step S147 is performed, the processing returns to step S142 and the processes described above are performed repeatedly. In other words, a process for smoothing the virtual speaker mute information a_spk_mute [spk_id] for the virtual speaker newly determined as a processing target.

On the other hand, in the case where it is decided in step S146 that spk_id<max_spk is not satisfied, since the smoothing of the virtual speaker mute information has been performed for all virtual speakers in the current frame, the smoothing process is ended.

The mute information generation section 22 performs the smoothing process for virtual speaker mute information taking the immediately preceding frame also into consideration in such a manner as described. By performing smoothing in such a manner, an appropriate virtual speaker signal with less sudden changes and noise can be obtained.

Figure 11:
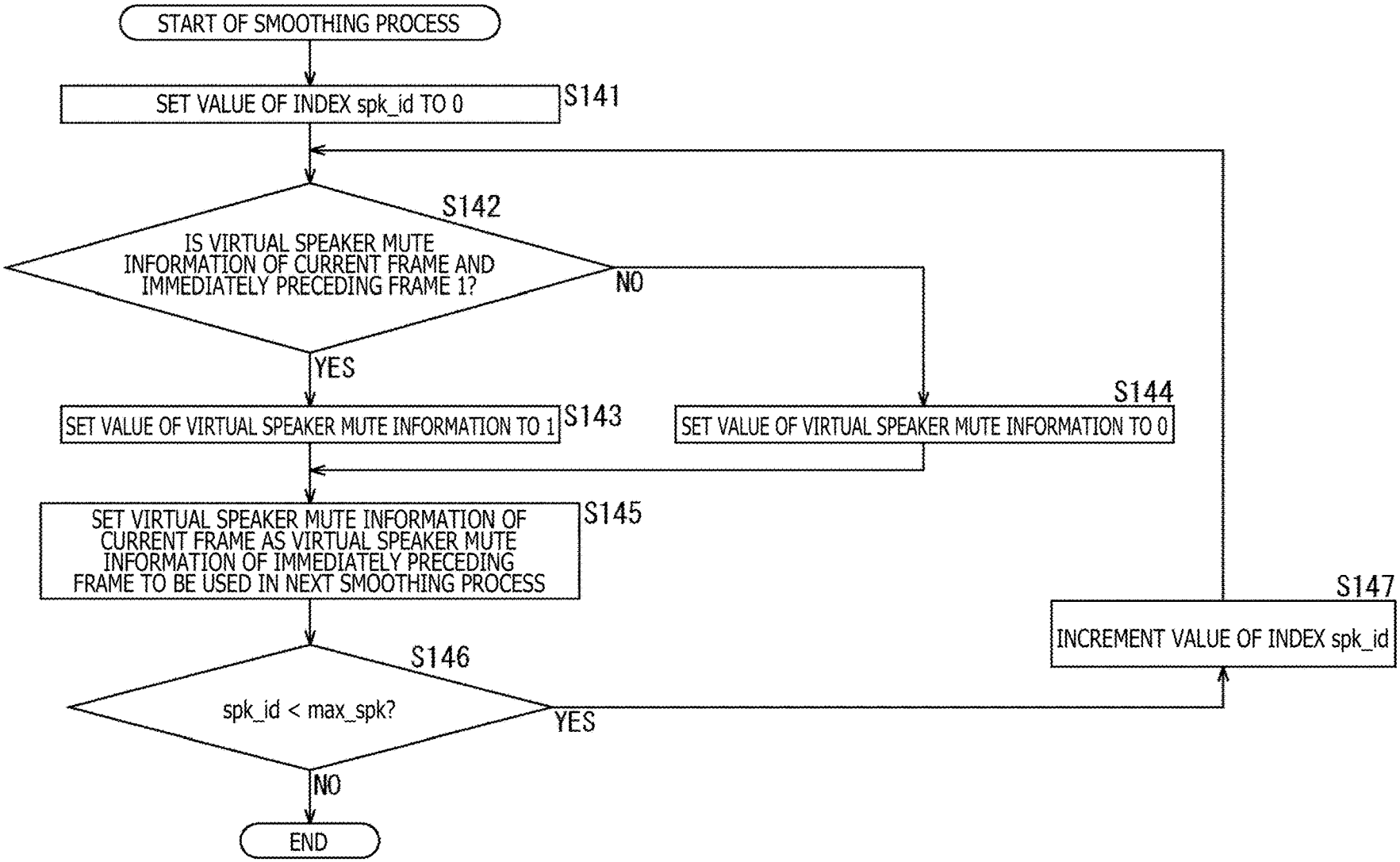
FIG. 11 is a flow chart illustrating a smoothing process.

In the case where the smoothing process depicted in FIG. 11 is performed, this signifies that the final virtual speaker mute information obtained in step S143 or step S144 is used in the gain application section 82 and the HRTF processing section 24.

Further, in step S72 of the virtual speaker signal generation process described hereinabove with reference to FIG. 9, the virtual speaker mute information obtained by the gain calculation process of FIG. 10 or the smoothing process of FIG. 11 is used.

In particular, the calculation of the expression (3) described hereinabove is generally performed to obtain a virtual speaker signal. In this case, all arithmetic operations are performed irrespective of whether not the object signal or the virtual speaker signal is a mute signal.

In contrast, the gain application section 82 obtains a virtual speaker signal by calculation of the following expression (5) taking audio object mute information and virtual speaker mute information supplied from the mute information generation section 22 into account.

[Math. 5]

$$\begin{bmatrix} SP(0,t) \\ SP(1,t) \\ \vdots \\ SP(M-1,t) \end{bmatrix} = \begin{bmatrix} \text{a_spk_mute}(0) \\ \text{a_spk_mute}(1) \\ \vdots \\ \text{a_spk_mute}(M-1) \end{bmatrix} \begin{bmatrix} G(0,0) & G(0,1) & \dots & G(0,N-1) \\ G(1,0) & G(1,1) & & G(1,N-1) \\ \vdots & \vdots & & \vdots \\ G(M-1,0) & G(M-1,1) & \dots & G(M-1,N-1) \end{bmatrix} \begin{bmatrix} \text{a_obj_mute}(0)S(0,t) \\ \text{a_obj_mute}(1)S(1,t) \\ \vdots \\ \text{a_obj_mute}(N-1)S(N-1,t) \end{bmatrix} \quad (5)$$

It is to be noted that, in the expression (5), SP(m,t) indicates a virtual speaker signal at time t of the mth (where m=0, 1, . . . , M−1) virtual speaker among M virtual speakers. Further, in the expression (5), S(n,t) indicates an object signal at time t of an nth (where n=0, 1, . . . , N−1) audio object among N audio objects.

Further, in the expression (5), G(m,n) indicates a gain to be multiplied to an object signal S(n,t) of the nth audio object for obtaining a virtual speaker signal SP(m,t) for the mth virtual speaker. In particular, the gain G(m,n) is a gain of each virtual speaker obtained in step S109 of FIG. 10.

Further, in the expression (5), a_spk_mute[spk_id] indicates a coefficient that is determined by the virtual speaker mute information a_spk_mute[spk_id] for the mth virtual speaker. In particular, in the case where the value of the virtual speaker mute information a_spk_mute[spk_id] is 1, the value of the coefficient a_spk_mute(m) is set to 0, and in the case where the value of the virtual speaker mute information a_spk_mute[spk_id] is 0, the value of the coefficient a_spk_mute(m) is set to 1.

Accordingly, in the case where the virtual speaker signal is mute (mute signal), the gain application section 82 does not perform arithmetic operation for the virtual speaker signal. In particular, the arithmetic operation for obtaining the virtual speaker signal SP(m,t) that is mute is not performed, and zero data is outputted as the virtual speaker signal SP(m,t). In other words, the arithmetic operation for the virtual speaker signal is omitted, and the arithmetic operation amount is reduced.

Further, in the expression (5), a_obj_mute(n) indicates a coefficient determined by the audio object mute information a_obj_mute[obj_id] regarding the object signal of the nth audio object.

In particular, in the case where the value of the audio object mute information a_obj_mute[obj_id] is 1, the value of the coefficient a_obj_mute(n) is set to 0, and in the case where the value of the audio object mute information a_obj_mute[obj_id] is 0, the value of the coefficient a_obj_mute(n) is set to 1.

Accordingly, in the gain application section 82, in the case where the object signal is mute (mute signal), the gain application section 82 does not perform arithmetic operation regarding the object signal. In particular, the product sum arithmetic operation of the term of the object signal S(n,t) that is mute is not performed. In other words, the arithmetic operation part based on the object signal is omitted, and the arithmetic operation amount is reduced.

It is to be noted that, in the gain application section 82, the arithmetic operation amount can be reduced if arithmetic operation of at least either one of the part of the object signal that is determined a mute signal or the part of the virtual speaker signal that is determined a mute signal is omitted. Accordingly, the example in which arithmetic operation of both the part of the object signal determined to be a mute signal and the part of the virtual speaker signal determined to be a mute signal are omitted is not restrictive, and arithmetic operation of one of them may be omitted.

In step S72 of FIG. 9, the gain application section 82 performs arithmetic operation similar to that of the expression (5) on the basis of the audio object mute information and the virtual speaker mute information supplied from the mute information generation section 22, gains supplied form the gain calculation section 81, and object signals supplied from the IMDCT processing section 54 to obtain a virtual speaker signal for each virtual speaker. Especially here, for a part at which arithmetic operation is omitted, zero data is used as an arithmetic operation result. In other words, actual arithmetic operation is not performed, and zero data is outputted as a value corresponding to the arithmetic operation result.

Generally, in the case where the calculation of the expression (3) is performed for certain time frames T, namely, during an interval during which the number of frames is T, arithmetic operation by M×N×T times is required.

However, it is assumed here that audio objects that are determined mute by audio object mute information are 30% of all audio objects and the number of virtual speakers that are determined mute by the virtual speaker mute information is 30% of all virtual speakers.

In such a case as just described, if the virtual speaker signal is obtained by calculation by the expression (5), then the arithmetic operation time is 0.7×M×0.7×N×T, and the arithmetic operation amount can be reduced approximately by 50% in comparison with that of the case of the expression (3). Besides, in this case, the virtual speaker signals obtained finally by the expression (3) and the expression (5) are same, and the omission of part of arithmetic operation does not give rise to an error.

Generally, in the case where the number of audio objects is great and the number of virtual speakers is also great, in spatial arrangement of the audio objects by a content creator, mute audio objects or mute virtual speakers are more likely to appear. In other words, intervals during which the object signal is mute or intervals during which the virtual speaker signal is mute are likely to appear.

Therefore, according to a method of omitting part of arithmetic operation like the expression (5), in such a case that the number of audio objects or the number of virtual speakers is great and the arithmetic operation amount is very grate, a higher reduction effect of the arithmetic operation amount can be achieved.

Further, if a virtual speaker signal is generated by the gain application section 82 and supplied to the HRTF processing section 24, then an output audio signal is generated in step S13 of FIG. 5.

In particular, in step S13, the HRTF processing section 24 generates an output audio signal on the basis of the virtual speaker mute information supplied from the mute information generation section 22 and the virtual speaker signal supplied from the gain application section 82.

Generally, an output audio signal is obtained by a convolution process of a transfer function that is an HRTF coefficient as indicated by the expression (4) and a virtual speaker signal.

However, in the HRTF processing section 24, the virtual speaker mute information is used to obtain an output audio signal in accordance with the following expression (6).

[Math. 6]

$$\begin{bmatrix} L(\omega) \\ R(\omega) \end{bmatrix} = \begin{bmatrix} \text{H_L}(0,\omega) & \text{H_L}(1,\omega) & \dots & \text{H_L}(M-1,\omega) \\ \text{H_R}(0,\omega) & \text{H_R}(1,\omega) & \dots & \text{H_R}(M-1,\omega) \end{bmatrix} \begin{bmatrix} \text{a_spk_mute}(0)SP(0,\omega) \\ \text{a_spk_mute}(1)SP(1,\omega) \\ \vdots \\ \text{a_spk_mute}(M-1)SP(M-1,\omega) \end{bmatrix} \quad (6)$$

It is to be noted that, in the expression (6), ω indicates a frequency, and SP(m,ω) indicates a virtual speaker signal of the frequency ω of the mth (where m=0, 1, . . . , M−1) virtual speaker among M virtual speakers. The virtual speaker signal SP(m,ω) can be obtained by time frequency conversion of the virtual speaker signal that is a time signal.

Further, in the expression (6), H_L(m,ω) indicates a transfer function for the left ear to be multiplied to the virtual speaker signal SP(m,ω) for the mth virtual speaker for obtaining an output audio signal L(ω) of the left channel. Similarly, H_R(m,ω) indicates a transfer function for the right ear.

Further, in the expression (6), a_spk_mute(m) indicates a coefficient determined by the virtual speaker mute information a_spk_mute[spk_id] regarding the mth virtual speaker. In particular, in the case where the value of the virtual speaker mute information a_spk_mute[spk_id] is 1, the value of the coefficient a_spk_mute(m) is set to 0, and in the case where the value of the virtual speaker mute information a_spk_mute[spk_id] is 0, the value of the coefficient a_spk_mute(m) is set to 1.

Accordingly, in the case where the virtual speaker signal is mute (mute signal) from the virtual speaker mute information, the HRTF processing section 24 does not perform arithmetic operation regarding the virtual speaker signal. In particular, the product sum arithmetic operation of the term of the virtual speaker signal SP(m,ω) that is mute is not performed. In other words, the arithmetic operation (process) for convoluting the virtual speaker signal that is mute and the transfer function is omitted, and the arithmetic operation amount is reduced.

Consequently, it is possible, in a convolution process in which the arithmetic operation amount is very great, for convolution arithmetic operation to be performed restrictively only for sounded virtual speaker signals, by which the arithmetic operation amount can be reduced significantly. Besides, in this case, the output audio signals obtained finally in accordance with both the expression (4) and the expression (6) are same as each other, and the omission of part of arithmetic operation does not give rise to an error.

As described above, according to the present technology, in the case where a mute interval (mute signal) exists in an audio object, by omitting processing of at least part of a decoding process, a rendering process, or an HRTF process, the arithmetic operation amount can be reduced without giving rise to any error in an output audio signal. In other words, high presence can be obtained even with a small amount of arithmetic operation.

Accordingly, in the present technology, since an average processing amount is reduced to reduce the power usage of the processor, it is possible to continuously reproduce a content for a longer period of time even with a portable apparatus such as a smartphone.

Second Embodiment

<Use of Object Priority>

Incidentally, in the MPEG-H Part 3:3D audio standard, a degree of priority of an audio object can be placed into metadata (bit stream) together with object position information indicative of a position of the audio object. It is to be noted that the degree of priority of an audio object is hereinafter referred to as object priority.

In the case where an object priority is included in metadata in such a manner, the metadata has, for example, such a format as depicted in FIG. 12.

In the example depicted in FIG. 12, "num_objects" indicates the total number of audio objects, and [object_priority] indicates the object priority.

Further, "position azimuth" indicates a horizontal angle of an audio object in a spherical coordinate system; "position elevation" indicates a vertical angle of the audio object in the spherical coordinate system; and "position radius" indicates a distance (radius) from the origin of the spherical coordinate system to the audio object. Here, information including the horizontal angle, vertical angle, and distance makes object position information indicative of a position of the audio object.

Further, in FIG. 12, the object priority object_priority is information of 3 bits and can assume a value from a low priority degree 0 to a high priority degree 7. In other words, a higher value of a priority degree from the priority degree 0 to the priority degree 7 indicates an audio object having a higher object priority.

For example, in the case where the decoding side cannot perform processing for all audio objects, it is possible to process only audio objects having high object priorities according to a resource of the decoding side.

In particular, it is assumed that, for example, there are three audio objects and the object priority of the audio objects is 7, 6, and 5. Further, it is assumed that the load of the processing apparatus is so high that it is difficult to process all of the three audio objects.

In such a case as just described, for example, it is possible not to execute a process for the audio object whose object priority is 5 but to execute a process only for the audio objects having the object priorities 7 and 6.

In addition, in the present technology, audio objects to be actually processed may be selected taking it also into consideration whether the signal of the audio object is mute.

In particular, for example, on the basis of spectral mute information or audio object mute information, any mute audio object is excluded from among plural audio objects in a frame of a processing target. Then, from among the remaining audio objects after the mute audio objects are excluded, the number of audio objects to be processed, which number is determined by a resource or the like, are selected in order in the descending order of the object priority.

In other words, at least either one of the decoding process or the rendering process is performed, for example, on the basis of spectral mute information or audio object mute information and the object priority.

For example, it is assumed that an input bit stream includes audio object data of five audio objects of an audio object AOB1 to an audio object AOB5, and the signal processing apparatus 11 has a room for processing only three audio objects.

At this time, for example, it is assumed that the value of the spectral mute information of the audio object AOB5 is 1 and the values of the spectral mute information of the other audio objects are 0. Further, it is assumed that the respective object priority of the audio object AOB1 to the audio object AOB4 are 7, 7, 6, and 5.

In such a case as just described, for example, the spectral decoding section 53 first excludes the audio object AOB5 that is mute from among the audio objects AOB1 to AOB5. Then, the spectral decoding section 53 selects the audio object AOB1 to the audio object AOB3 having high object priorities from among the remaining audio objects AOB1 to AOB4.

Then, the spectral decoding section 53 performs decoding of spectral data only of the audio objects AOB1 to AOB3 selected finally.

This makes it possible to reduce the number of audio objects to be substantially discarded even in such a case that the processing load of the signal processing apparatus 11 is so high that the signal processing apparatus 11 cannot perform processing of all of the audio objects.

<Example of Configuration of Computer>

While the series of processes described above can be executed by hardware, it can otherwise also be executed by software. In the case where the series of processes is executed by software, a program that constructs the software is installed into a computer. The computer here includes a computer that is incorporated in hardware for exclusive use, a personal computer, for example, for universal use that can execute various functions by installing various programs into the personal computer and so forth.

Figure 13:
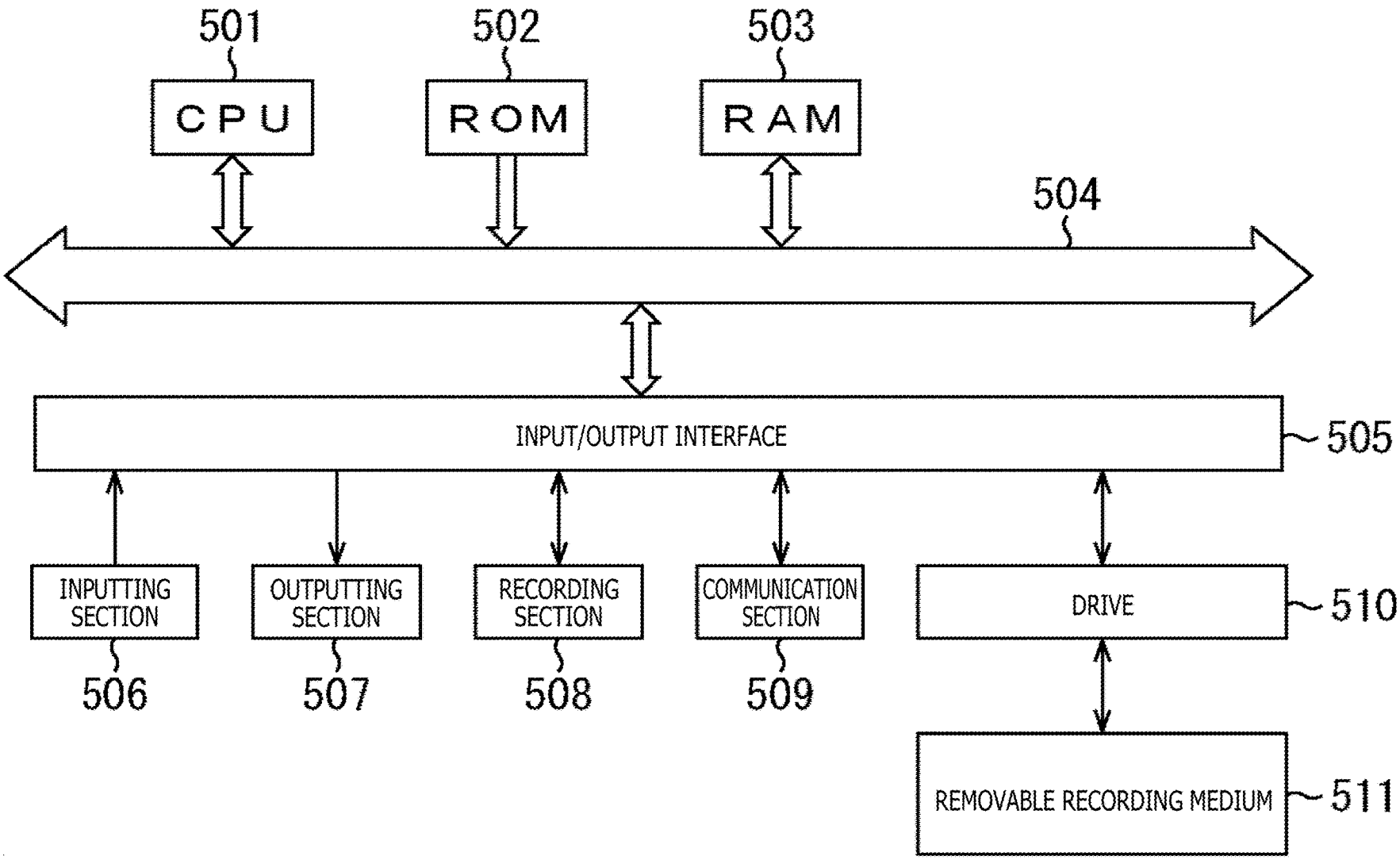
FIG. 13 is a view depicting an example of a configuration of a computer.

FIG. 13 is a block diagram depicting an example of a hardware configuration of a computer that executes the series of processes described hereinabove in accordance with a program.

In the computer, a CPU (Central Processing Unit) 501, a ROM (Read Only Memory) 502, and a RAM (Random Access Memory) 503 are connected to one another by a bus 504.

Further, an input/output interface 505 is connected to the bus 504. An inputting section 506, an outputting section 507, a recording section 508, a communication section 509, and a drive 510 are connected to the input/output interface 505.

The inputting section 506 includes, for example, a keyboard, a mouse, a microphone, an imaging element and so forth. The outputting section 507 includes a display, a speaker and so forth. The recording section 508 includes, for example, a hard disk, a nonvolatile memory or the like. The communication section 509 includes a network interface and so forth. The drive 510 drives a removable recording medium 511 such as a magnetic disk, an optical disk, a magneto-optical disk, or a semiconductor memory.

In the computer configured in such a manner as described above, the CPU 501 loads a program recorded, for example, in the recording section 508 into the RAM 503 through the input/output interface 505 and the bus 504 and executes the program to perform the series of processes described above.

The program to be executed by the computer (CPU 501) can be recorded on and provided as a removable recording medium 511 as, for example, a package medium. Further, the program can be provided through a wired or wireless transmission medium such as a local area network, the Internet, or a digital satellite broadcast.

In the computer, a program can be installed into the recording section 508 through the input/output interface 505 by mounting the removable recording medium 511 on the drive 510. Further, the program can be received by the communication section 509 through a wired or wireless transmission medium and installed into the recording section 508. Further, it is possible to install the program in the ROM 502 or the recording section 508 in advance.

It is to be noted that the program to be executed by a computer may be a program in which processes are performed in a time series in the order as described in the present specification or may be a program in which processes are executed in parallel or executed at necessary timings such as when the process is called.

Further, the embodiment of the present technology is not limited to the embodiments described hereinabove and allows various alterations without departing from the subject matter of the present technology.

For example, the present technology can assume a configuration for cloud computing by which one function is shared and cooperatively processed by plural apparatuses through a network.

Further, the steps described hereinabove in connection with the flow charts not only can be executed by a single apparatus but also can be shared and executed by plural apparatuses.

Further, in the case where plural processes are included in one step, the plural processes included in the one step not only can be executed by one apparatus but also can be shared and executed by plural apparatuses.

Further, the present technology can take the following configurations.

(1)

A signal processing apparatus, in which, on the basis of audio object mute information indicative of whether or not a signal of an audio object is a mute signal, at least either one of a decoding process or a rendering process of an object signal of the audio object is performed.

(2)

The signal processing apparatus according to (1), in which, in at least either one of the decoding process or the rendering process, either at least part of arithmetic operation is omitted or a value determined in advance is outputted as a value corresponding to a result of predetermined arithmetic operation according to the audio object mute information.

(3)

The signal processing apparatus according to (1) or (2), further including:

an HRTF processing section that performs an HRTF process on the basis of a virtual speaker signal obtained by the rendering process and used to reproduce sound by a virtual speaker and virtual speaker mute information indicative of whether or not the virtual speaker signal is a mute signal.

(4)

The signal processing apparatus according to (3), in which the HRTF processing section omits, from within the HRTF process, arithmetic operation for convoluting the virtual speaker signal determined to be a mute signal by the virtual speaker mute information and a transfer function.

(5)

The signal processing apparatus according to (3) or (4), further including:

a mute information generation section configured to generate the audio object mute information on the basis of information regarding a spectrum of the object signal.

(6)

The signal processing apparatus according to (5), further including:

a decoding processing section configured to perform the decoding process including decoding of spectral data of the object signal encoded by a context-based arithmetic encoding method, in which the decoding processing section does not perform calculation of a context of the spectral data determined as a mute signal by the audio object mute information but decodes the spectral data by using a value determined in advance as a result of calculation of the context.

(7)

The signal processing apparatus according to (6), in which the decoding processing section performs the decoding process including decoding of the spectral data and an IMDCT process for the decoded spectral data and outputs zero data without performing the IMDCT process for the decoded spectral data determined as a mute signal by the audio object mute information.

(8)

The signal processing apparatus according to any one of (5) to (7), in which the mute information generation section generates, on the basis of a result of the decoding process, another audio object mute information different from the audio object mute information used in the decoding process, and the signal processing apparatus further includes a rendering processing section configured to perform the rendering process on the basis of the another audio object mute information.

(9)

The signal processing apparatus according to (8), in which the rendering processing section performs a gain calculation process of obtaining a gain of the virtual speaker for each object signal obtained by the decoding process and a gain application process of generating the virtual speaker signal on the basis of the gain and the object signal as the rendering process.

(10)

The signal processing apparatus according to (9), in which the rendering processing section omits, in the gain application process, at least either one of arithmetic operation of the virtual speaker signal determined as a mute signal by the virtual speaker mute information or arithmetic operation based on the object signal determined as a mute signal by the another audio object mute information.

(11)

The signal processing apparatus according to (9) or (10), in which the mute information generation section generates the virtual speaker mute information on the basis of a result of the calculation of the gain and the another audio object mute information.

(12)

The signal processing apparatus according to any one of (1) to (11), in which at least either one of the decoding process or the rendering process is performed on the basis of a priority degree of the audio object and the audio object mute information.

(13)

A signal processing method, in which a signal processing apparatus performs, on the basis of audio object mute information indicative of whether or not a signal of an audio object is a mute signal, at least either one of a decoding process or a rendering process of an object signal of the audio object.

(14)

A program for causing a computer to process including a step of:

performing, on the basis of audio object mute information indicative of whether or not a signal of an audio object is a mute signal, at least either one of a decoding process or a rendering process of an object signal of the audio object.

REFERENCE LIST

11: Signal processing apparatus
21: Decoding processing section
22: Mute information generation section
23: Rendering processing section
24: HRTF processing section
53: Spectral decoding section
54: IMDCT processing section
81: Gain calculation section
82: Gain application section

The invention claimed is:

1. A signal processing apparatus comprising:

processing circuitry configured to:

perform, on a basis of audio object mute information indicative of whether or not a signal of an audio object is a mute signal, at least either one of a decoding process or a rendering process of an object signal of the audio object; and perform an HRTF (Head Related Transfer Function) process on a basis of a virtual speaker signal obtained by the rendering process and used to reproduce sound by a virtual speaker and virtual speaker mute information indicative of whether or not the virtual speaker signal is a mute signal.

2. The signal processing apparatus according to claim 1, wherein, in at least either one of the decoding process or the rendering process, either at least part of an arithmetic operation is omitted or a value determined in advance is outputted as a value corresponding to a result of a predetermined arithmetic operation according to the audio object mute information.

3. The signal processing apparatus according to claim 1, wherein the processing circuitry is configured to omit, from within the HRTF process, an arithmetic operation for convoluting the virtual speaker signal determined to be a mute signal by the virtual speaker mute information and a transfer function.

4. The signal processing apparatus according to claim 1, wherein the processing circuitry is configured to generate the audio object mute information on a basis of information regarding a spectrum of the object signal.

5. The signal processing apparatus according to claim 4, wherein the processing circuitry is configured to perform the decoding process including decoding of spectral data of the object signal encoded by a context-based arithmetic encoding method, and to not perform calculation of a context of the spectral data determined as a mute signal by the audio object mute information but decodes the spectral data by using a value determined in advance as a result of the calculation of the context.

6. The signal processing apparatus according to claim 5, wherein the processing circuitry is configured to perform the decoding process including decoding of the spectral data and an IMDCT (Inverse Modified Discrete Cosine Transform) process for the decoded spectral data and outputs zero data without performing the IMDCT process for the decoded spectral data determined as a mute signal by the audio object mute information.

7. The signal processing apparatus according to claim 4, wherein the processing circuitry is configured to generate, on a basis of a result of the decoding process, another audio object mute information different from the audio object mute information used in the decoding process, and to perform the rendering process on a basis of the other audio object mute information.

8. The signal processing apparatus according to claim 7, wherein the processing circuitry is configured to perform a gain calculation process of obtaining a gain of the virtual speaker for each object signal obtained by the decoding process and a gain application process of generating the virtual speaker signal on a basis of the gain and the object signal as the rendering process.

9. The signal processing apparatus according to claim 8, wherein the processing circuitry is configured to omit, in the gain application process, at least either one of an arithmetic operation on the virtual speaker signal determined as a mute signal by the virtual speaker mute information or an arithmetic operation based on the object signal determined as a mute signal by the other audio object mute information.

10. The signal processing apparatus according to claim 8, wherein the processing circuitry is configured to generate the virtual speaker mute information on a basis of a result of the calculation of the gain and the other audio object mute information.

11. The signal processing apparatus according to claim 1, wherein at least either one of the decoding process or the rendering process is performed on a basis of a priority degree of the audio object and the audio object mute information.

12. A signal processing method, executed by processing circuitry, the method comprising:

performing on a basis of audio object mute information indicative of whether or not a signal of an audio object is a mute signal, at least either one of a decoding process or a rendering process of an object signal of the audio object; and performing an HRTF (Head Related Transfer Function) process on a basis of a virtual speaker signal obtained by the rendering process and used to reproduce sound by a virtual speaker and virtual speaker mute information indicative of whether or not the virtual speaker signal is a mute signal.

13. A non-transitory computer readable medium storing instructions that, when executed by processing circuitry, perform a signal processing method comprising:

performing, on a basis of audio object mute information indicative of whether or not a signal of an audio object is a mute signal, at least either one of a decoding process or a rendering process of an object signal of the audio object; and performing an HRTF (Head Related Transfer Function) process on a basis of a virtual speaker signal obtained by the rendering process and used to reproduce sound by a virtual speaker and virtual speaker mute information indicative of whether or not the virtual speaker signal is a mute signal.

* * * * *